US006607569B1

(12) United States Patent
Namiki et al.

(10) Patent No.: US 6,607,569 B1
(45) Date of Patent: Aug. 19, 2003

(54) METHOD OF ESTIMATING REACTION PRODUCT IN COAL LIQUEFYING REACTION

(75) Inventors: Yasuki Namiki, Kisarazu (JP); Masatoshi Kobayashi, Tokyo (JP); Akira Kidoguchi, Ichihara (JP); Hidenobu Itoh, Ichihara (JP); Masataka Hiraide, Tokyo (JP); Kunihiro Imada, Kimitsu (JP); Kenji Inokuchi, Chiba (JP)

(73) Assignees: Sumitomo Metal Industries, Ltd., Osaka (JP); Idemitsu Kosan Co., Ltd., Tokyo (JP); Nippon Steel Corporation, Tokyo (JP); Chiyoda Corporation, Yokohama (JP); NKK Corporation, Tokyo (JP); Mitsui Engineering & Shipbuilding Co., Ltd., Tokyo (JP); Mitsubishi Heavy Industries, Ltd., Tokyo (JP); Japan Energy Corporation, Tokyo (JP); Sumitomo Metal Mining Co., Ltd., Tokyo (JP); Asahi Kasei Kogyo Kabushiki Kaisha, Osaka (JP); Sumitomo Coal Mining Co., Ltd., Tokyo (JP); The Japan Steel Works, Ltd., Tokyo (JP); Yokogawa Electric Corporation, Tokyo (JP)

( * ) Notice: Subject to any disclaimer, the term of this patent is extended or adjusted under 35 U.S.C. 154(b) by 0 days.

(21) Appl. No.: 09/623,753

(22) PCT Filed: Mar. 25, 1999

(86) PCT No.: PCT/JP99/01524

§ 371 (c)(1),
(2), (4) Date: Oct. 13, 2000

(87) PCT Pub. No.: WO99/50373

PCT Pub. Date: Oct. 7, 1999

(30) Foreign Application Priority Data

Mar. 25, 1998 (JP) ..... 10-096818

Mar. 23, 1999 (JP) ..... 11-078612

(51) Int. Cl.[7] ..... C10L 3/00

(52) U.S. Cl. ..... 44/903; 208/400; 208/401; 208/408

(58) Field of Search ..... 44/903; 208/400, 208/401, 408

(56) References Cited

PUBLICATIONS

Ericksson, S. et al. Treatment of liquid effluents from coal gasification plants. Energy Res. Abstr. 1980 5(15), Abstr. No. 23515, 1979.*

(List continued on next page.)

*Primary Examiner*—Cephia D. Toomer
(74) *Attorney, Agent, or Firm*—Oliff & Berridge, PLC

(57) ABSTRACT

Disclosed is a method of estimating the outflow amount for each component of the effluent of a coal liquefying reactor consisting of vessel type reactors (16*a*, 16*b*, 16*c*) operated under a high temperature and a high pressure. The outflow amount for each component of the effluent is assumed, and the gas-liquid equilibrium composition of the mixture of the composition within the reaction vessel is calculated. Further, the volume flow rates of the gaseous phase and the liquid phase within the reaction vessel are calculated, and the residence time (τ1G, τ2G, τ3G), (τ1S, τ2S, τ3S) of each of the gaseous phase and the liquid phase is calculated on the basis of the gas hold-up within the reaction vessel calculated on the basis of the volume flow rate and the empirical formula. The outflow amount for each component of the effluent is calculated on the basis of the residence time (τ1, τ, . . . τn) within the reaction vessel, the inflow amount for each component of the influent into the reactor, and the primary irreversible reaction rate formula derived from a specified coal liquefying reaction model. The effluent amount for each component assumed first is compared with the effluent amount for each component obtained by calculation, and the series of calculations are repeated until these two effluent amounts for each component coincide with each other within a predetermined range of error.

20 Claims, 9 Drawing Sheets

OTHER PUBLICATIONS

"Liquefaction", The Chemistry and Technology of Coal, J. G. Speight, Marceldekker, Inc. 1994.
" NEDOL Process", Japan Coal Oil K.K. catalog—Date unknown.
"Reaction Engineering", Kenji Hashimoto, Baifukan Publishing Co., 1993.
"Coal Conversion Utilization Technology", Yuzo Sanada, ICP, 1994.

* cited by examiner

METHOD OF ESTIMATING REACTION PRODUCT IN COAL LIQUEFYING REACTION

TECHNICAL FIELD

The present invention relates to a technique of forming a liquid hydrocarbon fuel from coal, particularly, to a method of estimating the effluent amounts of each of gaseous phase and liquid phase reaction products at the outlet of each bubbling tower (reaction vessel) of a multi-stage bubbling tower liquefying reactor using various kinds of coals as the raw material, said liquefying reactor being optionally scaled up by using an electronic computer.

BACKGROUND ART

Concerning the process for forming a hydrocarbon fuel directly from coal, various processes have been developed as a direct coal liquefying process including an IG process (The Chemistry and Technology of Coal. J.G. Speight, marceldekker, Inc. 1994, NEDOL process, Japan Coal Oil K.K. catalog). In each of these processes, in which coal is subjected to a hydrogenation cracking under a high temperature and a high pressure, a finely pulverized coal is dispersed in a hydrocarbon solvent to form a slurry and the resultant slurry is supplied to a reactor of a high temperature and a high pressure. In general, a slurry pre-heater is arranged in the front stage of the reactor for heating the coal slurry of room temperature to a temperature close to the reaction temperature in a relatively short time.

The coal liquefying reaction in the NEDOL process is a gas-liquid-solid heterogeneous phase reaction, in which a hydrogen gas is blown under a high temperature of about 450° C. and a high pressure of about 170 kg/cm$^2$ into a slurry consisting of the coal, a solvent and a catalyst so as to subject the coal to the hydrogenation cracking to form a liquid hydrocarbon. The type of the reactor is a completely mixed vessel column reactor consisting of at least three bubbling towers (reaction vessels) connected in series even in the pilot plant scale, in which the hydrogenation cracking proceeds in the bubbling tower reactor on the downstream side to make the molecular weight of the resultant hydrocarbon lower toward the bubbling tower reactor on the downstream side.

A most portion of the low molecular weight hydrocarbon having a low boiling point such as benzene, toluene and phenols is estimated to be present in the gaseous phase even under the high temperature and high pressure because of the gas-liquid equilibrium, with the result that the amount of the liquid phase component having a low boiling point is relatively decreased. Also, the liquefied oil having a low and intermediate boiling points is estimated to be present partly in the gaseous phase. As a result, the flow rate of the liquid phase within the bubbling tower reactor is decreased, and the residence time of the liquid phase tends to be increased with progress toward the bubbling tower reactor on the downstream side. In the extreme case, the liquid phase is developed into a coking trouble.

As described above, the gas-liquid equilibrium inherent in the series-connected multi-stage bubbling tower liquefying reactor is formed by the process conditions of each bubbling tower reactor, i.e., the reaction temperature, the reaction pressure, the composition of the liquid hydrocarbon flowing into the bubbling tower reactor, and the hydrogen gas amount. Also, the reactor is featured in that the reactor has its own residence time of the liquid phase, i.e., the reaction time, and the total reaction time is equal to the sum of the liquid phase residence time in each of the bubbling tower reactors.

The inorganic gas, hydrocarbon gas and the liquefied oil are present both in the gaseous phase and the liquid phase within the liquefying reaction tower. However, the ratio of the gaseous phase to the liquid phase within the reaction tower relates to the gas-liquid equilibrium under high temperatures and high pressures. It is difficult and highly troublesome to calculate the gas-liquid equilibrium of this kind and, thus, the equilibrium has scarcely been studied to date.

Under the circumstances, in the design of the series-connected multi-stage bubbling tower coal liquefying reactor, it was customary in the past to multiply the supply volume rate of the coal slurry under room temperature and atmospheric pressure by the apparent residence time on the assumption that the liquefying reaction is a liquid phase homogeneous reaction so as to obtain a reaction volume. Also, the volume of a single bubbling tower was obtained by dividing the reaction volume by the number of bubbling towers. It follows that the effluent amount of each component at the outlet of the reactor was estimated on the assumption that the residence time in each tower was equal to each other.

Similarly, where the reaction rate of the coal liquefying reaction is obtained from the experimental data obtained from the series-connected multi-stage bubbling tower coal liquefying reactor, the apparent residence time was obtained from the supply volume rate of the coal slurry under room temperature and atmospheric pressure and the volume of the reaction vessel. Alternatively, the residence time is estimated under assumed conditions, e.g., on the assumption that the liquefying reaction is a liquid phase homogeneous reaction, though the reaction is a heterogeneous reaction between a gaseous phase and a liquid phase, so as to obtain an analytical value under the assumed conditions and, thus, to estimate the reaction rate of each component of the reaction products (Reaction Engineering by Kenji Hashimoto, Baifukan Publishing Co., 1993).

In general, where the forming amount of the reaction product is estimated or where, by contraries, the reaction rate constant is obtained from the forming amount, some reaction model is set first so as to determine the reaction route. Also, the reaction rate formula is established so as to estimate the forming amount and to analyze the reaction rate. In the coal liquefying reaction, however, each of the raw material coal and the reaction product of the liquefied oil is a mixture having a complex composition, making it impossible to describe the reaction by the stoichiometry like the ordinary chemical reaction. Therefore, employed is the technique of classifying the coal or the liquefied oil into small groups each consisting of a mixture of components similar to each other in properties. In this case, the classified small group is handled as if the small group provides a pure substance in the ordinary chemical formula so as to analyze the reaction. Various methods of classifying the coal or the liquefied oil and various reaction models differing from each other in the reaction route have been proposed to date (Coal Conversion Utilization Technology, compiled by Yuzo Sanada, ICP, 1994).

As a general tendency, a complex reaction model, in which the coal or the liquefied oil is finely classified into many groups and various reaction routes are set among these groups, well coincides with the experimental data. However, where the reaction amount is estimated by using the complex model, a very large number of parameters that must be experimentally determined are required, making it difficult to analyze the reaction rate.

In performing the feasibility study of a coal liquefying plant, the size and the number of liquefying reactors are important factors giving a serious influence to the construction cost of the plant. In order to make optimum the size and the number of liquefying reactors, it is necessary to conduct many case studies. To be more specific, it is necessary to estimate the forming amount of each component of the liquefied product under various operating conditions.

In the conventional method of estimating the forming amount that has been employed to date, used is an apparent residence time as already pointed out, making it substantially impossible to deal with the changes in the scale and shape of the reactor and in the number of reaction towers. Needless to say, the changes in the operating conditions such as the reaction temperature and the blowing amount of the hydrogen gas are not reflected at all in the residence time. Naturally, the conventional estimating method was indeed insufficient.

For conducting the feasibility study of a coal liquefying plant, required is an estimating technology, in which the flow rates of the gaseous phase and the liquid phase are estimated in view of the gas-liquid equilibrium within each reaction tower, a true residence time is obtained for each reaction tower based on the estimated flow rates, and the forming amount of the liquefied product can be estimated by using the true residence time thus obtained.

Also, where the forming amount is estimated by using the true residence time, it is also necessary for the reaction rate constant used for the estimation to be a reaction rate constant based on the true residence time. An estimating technology, in which the flow rates of the gaseous phase and the liquid phase are estimated in view of the gas-liquid equilibrium within each reaction tower, a true residence time is obtained for each reaction tower based on the estimated flow rates, and the reaction rate constant of the liquefying reaction can be estimated by using the true residence time thus obtained, is required in also the case where the reaction rate of the coal liquefying reaction is obtained from the experimental data in the series-connected multi-stage bubbling tower coal liquefying reactor.

Where the forming amount of the liquefied product is estimated or the reaction rate constant is calculated by using the true residence time, the technology for terminating the calculation by trial and error is absolutely necessary, because the true residence time itself is a function of the forming amount of the liquefied product. Therefore, in the case of using an excessively complex reaction model, the calculation is unlikely to be terminated by trial and error, making it impossible to carry out the estimation. Particularly, where the reaction rate of the coal liquefying reaction is obtained from the experimental data obtained from the series connected multi-stage bubbling tower coal liquefying reactor, it is very difficult to perform analysis for obtaining parameters such as the reaction rate constant in the case of using a complex reaction model.

On the other hand, if the reaction model is excessively simplified, it is impossible to depict the actual reaction phenomenon. As already described, in the coal liquefying reaction, each of the raw material coal and the reaction product of the liquefied oil is a mixture having complex composition, making it impossible to describe the coal liquefying reaction by the stoichiometry like the ordinary chemical reaction. If the reaction is excessively simplified, it is impossible to depict the difference in the reactivity depending on the kind of the coal and the difference in the forming amount for each component of the liquefied product.

To be more specific, for the estimation using a true residence time, it is required to establish a reaction model having a complexity such that the actual reaction phenomenon can be depicted and, at the same time, a simplicity such that the analysis for obtaining the parameter such as a reaction rate constant is not made troublesome and to determine actually the parameter.

The composition and properties of the coal to be liquefied widely differ from each other depending on the kind, the place of production, or the like of the coal. Therefore, even if a simple reaction model is established such that the analysis for obtaining the parameter such as the reaction rate constant is not made difficult, it is necessary to set up the optimum conditions in actually liquefying the coal based on the reaction model. Specifically, in order to select the reaction temperature, the reaction pressure and the reaction time adapted for the kind of the coal (raw material coal), it is necessary to conduct a continuous demonstrating operation by using a bench scale plant or a pilot plant and to evaluate the yield and the ratios of the components of the obtained hydrocarbon fuel so as to set up the optimum conditions. It follows that a tremendous developing cost and much time are required for each kind of the coal. Under the circumstances, it is strongly required to develop the technology that permits easily selecting the conditions for the liquefying reaction such as the reaction temperature, the reaction pressure and reaction time and also permits easily selecting the reaction rate constant.

DISCLOSURE OF THE INVENTION

An object of the present invention, which has been achieved in view of the requirements described above, is to provide an estimation simulating technology that permits depicting the actual reaction phenomenon and also permits estimating the forming amount of the liquefied product by using a true residence time in the coal liquefying reaction.

The present invention, which has been achieved in view of the requirement described above, is intended to provide the technology that permits easily obtaining the reaction rate constant for each of different kinds of coals without requiring the experiment involving a tremendous developing cost and without requiring the demonstrating operation by using a continuous apparatus.

The object described above has been achieved by developing a method for estimating the effluent amount for each component of the effluent from a coal liquefying reactor formed of a vessel type reactor operated under a high temperature and a high pressure by using an electronic computer based on the residence time in view of the gas-liquid equilibrium, by developing another method for estimating the reaction rate constant of the coal liquefying reaction from the experimental data of the effluent amount for each component of the effluent from the N-th vessel of a vessel column reactor operated under a high temperature and a high pressure and consisting of N-number of vessels based on the residence time in view of the gas-liquid equilibrium, by establishing a reaction model having a complexity such that the actual reaction phenomenon can be depicted and also having a simplicity such that the analysis for obtaining the parameter such as the reaction rate constant is not rendered difficult, and by actually determining the parameter.

Also, the object of the present invention has been achieved by analyzing the rate of the liquefying reaction by using the reaction model so as to obtain a reaction rate constant with respect to a plurality of coals differing from each other in the degree of coalification and by allowing the obtained reaction rate constant to relate to the component of the coal the properties of which can be specified.

According to a first aspect of the present invention, there is provided a method of estimating the effluent amount for each component of the effluent at the outlet of a reaction vessel in which a liquefying reaction is carried out by blowing a hydrogen gas into a coal slurry, comprising the steps of calculating the reaction vessel residence time within the reaction vessel for each of the gaseous phase and the liquid phase by assuming the effluent amount for each component of the effluent; calculating the effluent amount for each component of the effluent on the basis of the reaction vessel residence time, the inflow amount for each component of the influent into the reactor, and a primary irreversible reaction rate formula derived from a predetermined coal liquefying reaction model; and repeating the calculation until the assumed effluent amount for each component coincides within a predetermined range of error with the effluent amount for each component obtained by calculation so as to determine the estimated value of the effluent amount for each component.

According to a second aspect of the present invention, there is provided a method of estimating the effluent amount for each component of the effluent of a coal liquefying reactor formed of a vessel type reactor operated under a high temperature and a high pressure, comprising the steps of assuming the effluent amount for each component of the effluent so as to calculate a gas-liquid equilibrium composition within the reaction vessel of a mixture of the composition; further calculating the volume flow rates of the gaseous phase and the liquid phase within the reaction vessel; calculating the residence time of the gaseous phase and the liquid phase within the reaction vessel on the basis of the gas hold up within the reaction vessel calculated from the volume flow rate and the empirical formula; calculating the effluent amount for each component of the effluent on the basis of a primary irreversible reaction rate formula derived from the residence time within the reaction vessel, the inflow amount for each component of the influent into the reactor, and a specified coal liquefying reaction model; comparing the effluent amount for each component assumed first with the effluent amount for each component obtained by calculation; and repeating the series of calculations until the two effluent amounts for each component are allowed to coincide with each other for each component within a predetermined range of error.

According to a third aspect of the present invention, there is provided a method of estimating a reaction rate constant for a coal liquefying reaction on the basis of the actually measured value of the effluent amount for each component of the N-th vessel of a vessel column reactor consisting of an N-number of vessels and operated under a high temperature and a high pressure, comprising the steps of assuming a reaction rate constant; successively calculating the effluent amount for each component of the effluent from each vessel until the N-th vessel by using the assumed reaction rate constant; comparing the calculated value of the effluent amount for each component of the N-th vessel with the actually measured value; and repeating the series of calculations until these two sets of the effluent amounts for each component are allowed to coincide with each other within a predetermined range of error.

According to a fourth aspect of the present invention, there is provided a method of estimating the reaction rate constant of the coal liquefying reaction on the basis of the actually measured value of the effluent for each component of the N-th vessel of a vessel column reactor consisting of an N-number of vessels and operated under a high temperature and a high pressure, comprising the steps of assuming a reaction rate constant; successively calculating the effluent amount for each component of the effluent from each vessel until the N−1-th vessel by using the assumed reaction rate constant; newly calculating a reaction rate constant on the basis of the effluent amount for each component of the N−1-th vessel and the effluent amount for each component of the N-th vessel; comparing the reaction rate constant assumed first with the reaction rate constant newly obtained by calculation; and repeating the series of calculations until these two sets of reaction rate constants are allowed to coincide with each other for each reaction rate constant within a predetermined range of error.

According to a fifth aspect of the present invention, there is provided a method of estimating the effluent amount for each component of the effluent of a coal liquefying reactor consisting of a bubble tower reactor operated under a high temperature and a high pressure, wherein used is a primary irreversible reaction rate formula derived from a reaction model in which a coal excluding water and ash is classified into three components consisting of a component having a high liquefying reactivity, a component having a low liquefying reactivity and a component highly unlikely to be liquefied; the liquefied oil and the solid liquefied product are classified into four components consisting of a liquefied oil component having a low boiling point, a liquefied oil component having an intermediate boiling point, a liquefied oil component having a high boiling point, and asphaltenes containing the liquefied oil; the other liquefied product is classified into four components consisting of a lower hydrocarbon gas, carbon monoxide and carbon dioxide gases, water, and hydrogen sulfide and ammonia gases; and the coal is decomposed by the reaction among 12 components consisting of the three components of the coal, the four components of the liquefied oil and the solid liquefied products, the four components of the other liquefied product, and hydrogen into a liquefied product along the reaction route in which a consecutive reaction and a parallel reaction of a first order irreversible reaction are combined, and the liquefied product is further decomposed partly into another liquefied product having a smaller molecular weight.

The present invention also provides a method of estimating the reaction rate constant of a coal liquefying reaction on the basis of the actually measured value of the effluent amount for each component of the N-th vessel of a vessel column reactor consisting of an N-number of vessels and operated under a high temperature and a high pressure, wherein used is a primary irreversible reaction rate formula derived from a reaction model in which a coal excluding water and ash is classified into three components consisting of a component having a high liquefying reactivity, a component having a low liquefying reactivity and a component highly unlikely to be liquefied; the liquefied oil and the solid liquefied product are classified into four components consisting of a liquefied oil component having a low boiling point, a liquefied oil component having an intermediate boiling point, a liquefied oil component having a high boiling point, and asphaltenes containing the liquefied oil; the other liquefied product is classified into four components consisting of a lower hydrocarbon gas, carbon monoxide and carbon dioxide gases, water, and hydrogen sulfide and ammonia gases; and the coal is decomposed by the reaction among 12 components consisting of the three components of the coal, the four components of the liquefied oil and the solid liquefied products, the four components of the other liquefied product, and hydrogen into a liquefied product along the reaction route in which a consecutive reaction and a parallel reaction of a primary reversible reaction are combined, and the liquefied product is further decomposed partly into another liquefied product having a smaller molecular weight.

The present invention also provides a method of estimating the effluent amount for each component of the effluent of a coal liquefying reactor consisting of a bubbling tower reactor operated under a high temperature and a high pressure, wherein, when the liquefied oil or the solid liquefied product is classified into four components consisting of a liquefied oil component having a low boiling point, a liquefied oil component having an intermediate boiling point, a liquefied oil component having a high boiling point, and asphaltenes containing the liquefied oil, and when the other liquefied product is classified into four components consisting of a group of a lower hydrocarbon gas, a group consisting of carbon monoxide and carbon dioxide gases, a group consisting of water alone, and another group consisting of hydrogen sulfide and ammonia gases, the hydrocarbon compound group having 1 to 3 carbon atoms is classified as a lower hydrocarbon gas, a liquefied oil having a boiling point not higher than 220° C. under atmospheric pressure and excluding the lower hydrocarbon gas is classified as a liquefied oil component having a low boiling point, a liquefied oil having a boiling point not lower than 220° C. and lower than 350° C. under atmospheric pressure is classified as a liquefied oil component having an intermediate boiling point, a liquefied oil having a boiling point not lower than 350° C. and lower than 538° C. under atmospheric pressure is classified as a liquefied oil component having a high boiling point, and a liquefied oil having a boiling point not lower than 538° C. under atmospheric pressure and a solid component soluble in tetrahydrofuran are classified as asphaltenes.

The present invention also provides a method of estimating the reaction rate constant of a coal liquefying reaction on the basis of the actually measured value of the effluent amount for each component of the N-th vessel of a vessel column reactor consisting of an N-number of vessels and operated under a high temperature and a high pressure, wherein, when the liquefied oil or the solid liquefied product is classified into four components consisting of a liquefied oil component having a low boiling point, a liquefied oil component having an intermediate boiling point, a liquefied oil component having a high boiling point, and asphaltenes containing the liquefied oil, and when the other liquefied product is classified into four components consisting of a group of a lower hydrocarbon gas, a group consisting of carbon monoxide and carbon dioxide gases, a group consisting of water alone, and another group consisting of hydrogen sulfide and ammonia gases, the hydrocarbon compound group having 1 to 3 carbon atoms is classified as a lower hydrocarbon gas, a liquefied oil having a boiling point not higher than 220° C. under atmospheric pressure and excluding the lower hydrocarbon gas is classified as a liquefied oil component having a low boiling point, a liquefied oil having a boiling point not lower than 220° C. and lower than 350° C. under atmospheric pressure is classified as a liquefied oil component having an intermediate boiling point, a liquefied oil having a boiling point not lower than 350° C. and lower than 538° C. under atmospheric pressure is classified as a liquefied oil component having a high boiling point, and a liquefied oil having a boiling point not lower than 538° C. under atmospheric pressure and a solid component soluble in tetrahydrofuran are classified as asphaltenes.

The present invention also provides a method of estimating the effluent amount for each component of the effluent of a coal liquefying reactor formed of a bubbling tower reactor operated under a high temperature and a high pressure, wherein, when the coal excluding the ash component is classified into three components consisting of a component having a high liquefying reactivity, a component having a low liquefying reactivity, and a component highly unlikely to be liquefied, the component of the coal having at least 0.5/min of a primary irreversible reaction rate constant of the conversion reaction from the coal into a liquefied product at 450° C. is classified as the component having a high liquefying reactivity, the component of the coal having the primary irreversible reaction constant smaller than 0.5/min and not smaller than $10^{-4}$/min is classified as the component having a low liquefying reactivity, and the component of the coal having the primary irreversible reaction constant smaller than $10^{-4}$/min is classified as the component highly unlikely to be liquefied.

The present invention also provides a method of estimating the effluent amount for each component of the effluent at the outlet of a reaction vessel in which a hydrogen gas is blown into a coal slurry for carrying out a liquefying reaction, comprising the steps of assuming the effluent amount for each component of the effluent in accordance with a coal liquefying reaction model set in advance in respect of each of a plurality of kinds of coal slurries differing from each other in the degree of coalification and calculating the residence time in the reaction vessel for each of the gaseous phase and the liquid phase within the reaction vessel; calculating the effluent amount for each component of the effluent on the basis of the residence time in the reaction vessel, the inflow amount for each component of the influent into the reaction vessel, and a primary irreversible reaction rate formula derived from the coal liquefying reaction model; obtaining a reaction rate constant of the primary irreversible reaction rate formula, which permits the calculated effluent amount for each component and the assumed effluent amount for each component to coincide with each other within a predetermined range of error, followed by obtaining a formula showing the relationship between the component of the coal and the reaction rate constant on the basis of the reaction rate constant obtained for each kind of the coal; and applying the formula showing the particular relationship to an optional kind of coal so as to calculate the reaction rate constant, thereby estimating the effluent amount for each component of the effluent on the basis of the coal liquefying reaction model.

Where coal having a different degree of coalification is liquefied, the reaction rate constant for the coal can be easily obtained in the present invention by substituting the component of the coal in the obtained relationship. Therefore, it is unnecessary to carry out a continuous demonstrating operation using a bench scale plant or a pilot plant, which was required in the past for each of different kinds of coals, making it possible to markedly save the expenses and time required for the development of the coal liquefying technology. The present invention makes it possible to select the kinds of the raw material coals and to study the reacting conditions such as the reaction temperature, the reaction pressure and the reaction time, leading to the possibility of making optimum the shape of the reactor (reaction vessel).

Where the coal excluding water and the ash component is classified into three components consisting of a component having a high liquefying reactivity, a component having a low liquefying reactivity, and a component highly unlikely to be liquefied, where the liquefied oil and the solid liquefied product of the effluent is classified into four components consisting of a component having a low boiling point, a component having an intermediate boiling point, a component having a low boiling point, asphaltenes containing a liquefied oil, and where the other liquefied product of the effluent is classified into four components consisting of a group of a lower hydrocarbon gas, a group of carbon monoxide and carbon dioxide gases, a group consisting of water alone, and a group consisting of hydrogen sulfide and ammonia, the relationship between the reaction rate constant and the component of the coal can be represented as follows:

$$K32=K32_0\times10^{A32\{(H/C)\times VM\}+B32} \quad \text{[formula 1]}$$

$$K43=K43_0\times10^{A43\{(H/C)\times VM\}+B43} \quad \text{[formula 2]}$$

$$K54=K54_0\times10^{A54\{(H/C)\times VM\}+B54} \quad \text{[formula 3]}$$

$$K63=K63_0\times10^{A63\{(H/C)\times VM\}+B63} \quad \text{[formula 4]}$$

$$K73=K73_0\times10^{A73\{(H/C)\times VM-O\}+B73} \quad \text{[formula 5]}$$

$$K103=K103_0\times10^{A103\{(H/C)\times O\}+B103} \quad \text{[formula 6]}$$

$$K93=K93_0\times10^{A93\{N+S\}+B93} \quad \text{[formula 7]}$$

$$K81=K81_0\times10^{A81\{(H/C)\times O\}+B91} \quad \text{[formula 8]}$$

$$K10=K10_0\times10^{A10\{(H/C)\times VM\}+B10} \quad \text{[formula 9]}$$

where, K32 is a reaction rate constant of the reaction for producing the asphaltenes from the component of the coal having a low liquefying reactivity;

K43 is a reaction rate constant of the reaction for producing the liquefied oil component having a high boiling point from the asphaltenes;

K54 is a reaction rate constant of the reaction for producing the liquefied oil component having an intermediate boiling point from the liquefied oil component having a high boiling point;

K63 is a reaction rate constant of the reaction for producing the liquefied oil component having a low boiling point from the asphaltenes;

K73 is a reaction rate constant of the reaction for producing the lower hydrocarbon gas from the asphaltenes;

K103 is a reaction rate constant of the reaction for producing the water from the asphaltenes;

K93 is a reaction rate constant of the reaction for producing the hydrogen sulfide and ammonia from the asphaltenes;

K81 is a reaction rate constant of the reaction for producing the hydrogen monoxide gas and the hydrogen dioxide gas from the component of the coal having a high liquefying reactivity; and K10 is a reaction rate constant of the reaction between the hydrogen gas and the asphaltenes, where H/C represents the ratio of the hydrogen atom to the carbon atom contained in the dry coal;

O represents the weight ratio of oxygen contained in the dry coal;

N represent the weight ratio of nitrogen contained in the dry coal;

S represents the weight ratio of sulfur contained in the dry coal; and

VM represents the weight ratio of the volatile component contained in the dry coal, and where A32 represents the inclination of the straight line represented by formula (1), covering the case where (H/C)×VM is plotted on the abscissa and K32 is plotted on the logarithmic scale on the ordinate;

$K32_0$ represents a part of the intercept of the straight line crossing the ordinate, which denotes the value of K32 at (H/C)×VM of the predetermined kind of coal used for obtaining the relationship noted above;

B32 represents a part of the intercept of the straight line noted above, which denotes a value equal to −A32{(H/C)×VM} in the case where $K32=K32_0$;

A43 represents the inclination of the straight line represented by formula (2), covering the case where (H/C)×VM is plotted on the abscissa and K43 in a logarithmic scale is plotted on the ordinate;

$K43_0$ is a part of the intercept of the straight line crossing the ordinate, which denotes the value of K43 at (H/C)×VM of the predetermined kind of coal used for obtaining the particular relationship;

B43 represents a part of the intercept of the straight line, which denotes the value equal to −A43{(H/C)×VM} when $K43=K43_0$;

A54 represents the inclination of the straight line represented by formula (3), covering the case where (H/C)×VM is plotted on the abscissa and K54 is plotted in a logarithmic scale on the ordinate;

$K54_0$ represents a part of the intercept of the straight line crossing the ordinate, which denotes the value of K54 at (H/C)×VM of the predetermined kind of the coal used for obtaining the relationship;

B54 represents a part of the intercept of the straight line, which denotes a value equal to −A54{(H/C)×VM} when $K54=K54_0$;

A63 represents the inclination of the straight line represented by formula (4), covering the case where (H/C)×VM is plotted on the abscissa and K63 is plotted in a logarithmic scale on the ordinate;

$K63_0$ represents a part of the intercept of the straight line crossing the ordinate, which denotes the value of K63 at (H/C)×VM of the predetermined kind of the coal used for obtaining the relationship;

B63 represents a part of the intercept of the straight line, which denotes a value equal to −A63{(H/C)×VM} when $K63=K63_0$;

A73 represents the inclination of the straight line represented by formula (5), covering the case where (H/C)×VM is plotted on the abscissa and K73 is plotted in a logarithmic scale on the ordinate;

$K73_0$ represents a part of the intercept of the straight line crossing the ordinate, which denotes the value of K73 at (H/C)×VM of the predetermined kind of the coal used for obtaining the relationship;

B73 represents a part of the intercept of the straight line, which denotes a value equal to −A73{(H/C)×(VM−O)} when $K73=K73_0$;

A103 represents the inclination of the straight line represented by formula (6), covering the case where (H/C)×O is plotted on the abscissa and K103 is plotted in a logarithmic scale on the ordinate;

$K103_0$ represents a part of the intercept of the straight line crossing the ordinate, which denotes the value of K103 at (H/C)×O of the predetermined kind of the coal used for obtaining the relationship;

B103 represents a part of the intercept of the straight line, which denotes a value equal to $-A103\{(H/C)\times O\}$ when $K103=K103_0$;

A93 represents the inclination of the straight line represented by formula (7), covering the case where (N+S) is plotted on the abscissa and K93 is plotted in a logarithmic scale on the ordinate;

$K93_0$ represents a part of the intercept of the straight line crossing the ordinate, which denotes the value of K93 at (N+S) of the predetermined kind of the coal used for obtaining the relationship;

B93 represents a part of the intercept of the straight line, which denotes a value equal to $-A93(N+S)\times VM\}$ when $K93=K93_0$;

A81 represents the inclination of the straight line represented by formula (8), covering the case where (H/C)×O is plotted on the abscissa and K81 is plotted in a logarithmic scale on the ordinate;

$K81_0$ represents a part of the intercept of the straight line crossing the ordinate, which denotes the value of K81 at (H/C)×O of the predetermined kind of the coal used for obtaining the relationship;

B81 represents a part of the intercept of the straight line, which denotes a value equal to $-A81\{(H/C)\times O\}$ when $K81=K81_0$;

A10 represents the inclination of the straight line represented by formula (9), covering the case where (H/C)×VM is plotted on the abscissa and K10 is plotted in a logarithmic scale on the ordinate;

$K10_0$ represents a part of the intercept of the straight line crossing the ordinate, which denotes the value of K10 at (H/C)×VM of the predetermined kind of the coal used for obtaining the relationship; and B10 represents a part of the intercept of the straight line, which denotes a value equal to $-A10\{(H/C)\times VM\}$ when $K10=K10_0$.

BEST MODE OF WORKING THE INVENTION

Figure 2:
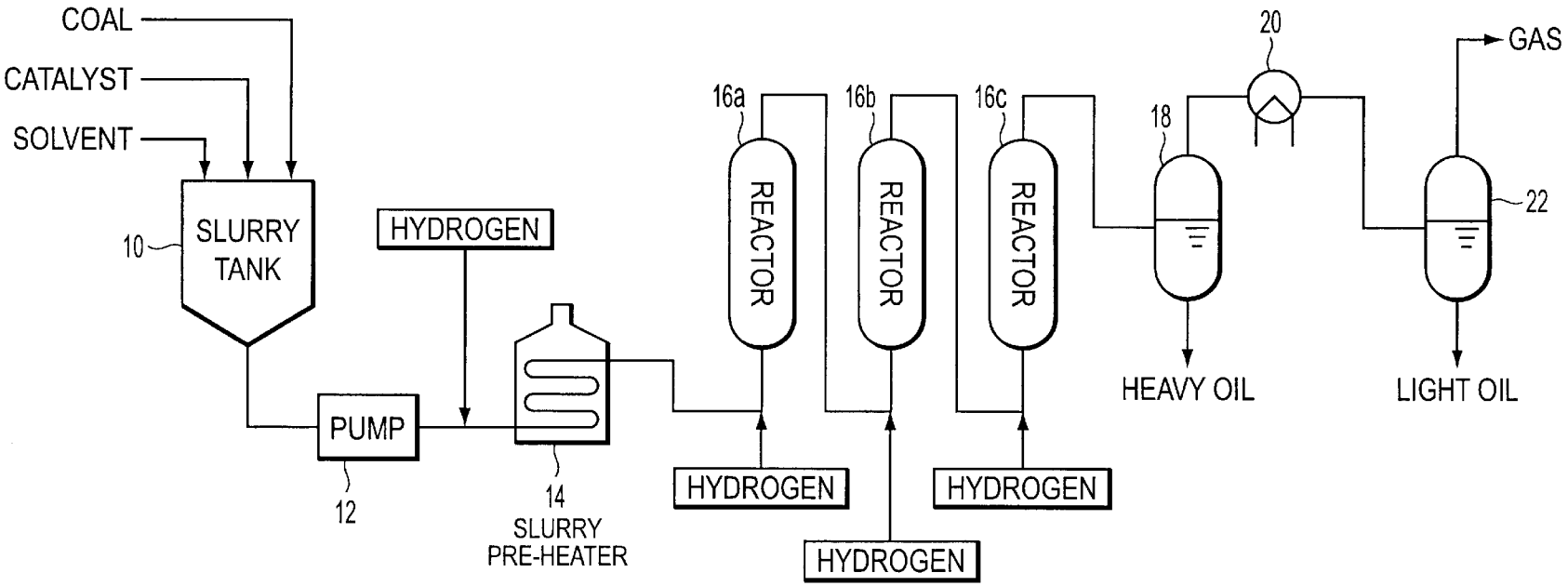
FIG. 2 is a block diagram schematically showing construction of the coal liquefying reaction process.

The specific mode of working the present invention will now be described with reference to the accompanying drawings. Specifically, FIG. 2 is a block diagram schematically showing the process of the coal liquefying reaction. As shown in the drawing, a mixture consisting of 40 to 50% by weight of finely pulverized coal, 60 to 50% by weight of a solvent such as tetralin, and 0.5 to 3% by weight of a catalyst such as a finely pulverized natural pearlite is kneaded in a slurry tank 10, and the resultant coal slurry is forwarded into a slurry pre-heater 14 by a pump 12. A hydrogen gas is added to the coal slurry before the coal slurry is forwarded into the pre-heater 14. The slurry is heated from room temperature to about 400° C. immediately before the reaction temperature and, then, introduced into reaction towers (reaction vessels) 16 (16*a*, 16*b*, 16*c*), which are connected in series. A hydrogen gas is added to the slurry immediately before the slurry is introduced into each of the reaction towers 16*a* to 16*c*, with the result that the liquefying reaction is carried out within each of these reaction towers 16*a* to 16*c*. The reaction mixture withdrawn from the final stage reaction tower is introduced into a low temperature gas-liquid separator 22 through a high temperature gas-liquid separator 18 and a slurry heat exchanger 20. The liquid component separated from the high temperature gas-liquid separator 18 is extracted as a so-called "heavy oil" component. Likewise, the liquid component separated from the low temperature gas-liquid separator 22 is extracted as a so-called "light oil" component. At the same time, a gas component is withdrawn from the low temperature gas-liquid separator 22.

Figure 1:
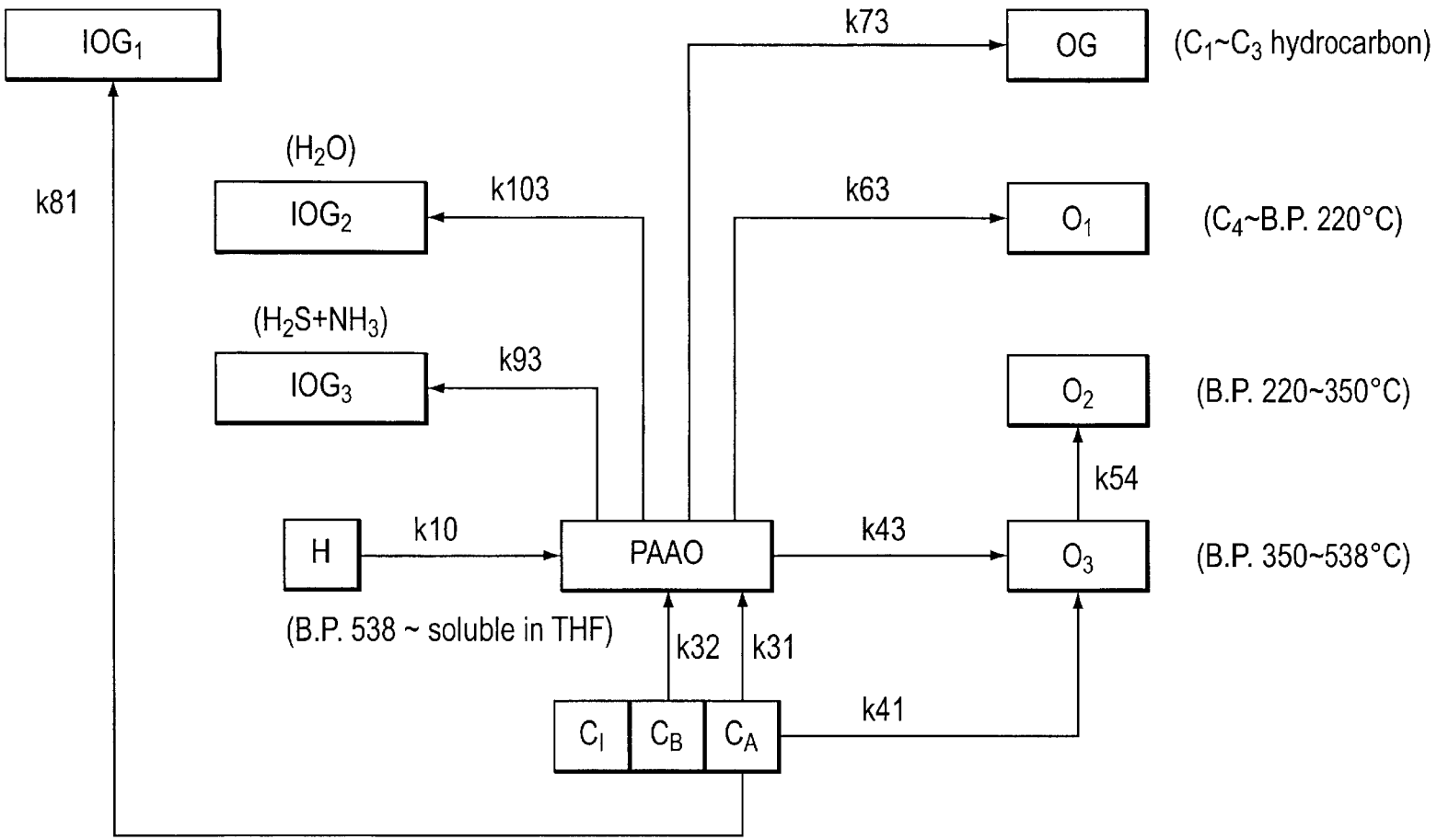
FIG. 1 shows a model of a coal liquefying reaction used in a program of the present invention.

In the process of the coal liquefying reaction described above, the reaction model of the present invention is constructed as follows in order to estimate the product yield in each of the reaction towers 16. FIG. 1 shows the reaction model of the present invention. In the reaction model of the present invention, the liquefied reaction product is classified into an organic gas (represented by a symbol OG in FIG. 1), which is a lower hydrocarbon gas having 1 to 3 carbon atoms, a liquefied oil having a low boiling point (represented by $O_1$ in FIG. 1), which is a liquefied oil having a low boiling point, i.e., a fraction ranging between the hydrocarbon having 4 carbon atoms and a fraction having a boiling point lower than 220° C., a liquefied oil having an intermediate boiling point (represented by $O_2$ in FIG. 1), which is an oil having a boiling point not lower than 220° C. and lower than 350° C., a liquefied oil having a high boiling point (represented by $O_3$ in FIG. 1), which is an oil having a boiling point not lower than 350° C. and lower than 538° C., asphaltenes (represented by PAAO in FIG. 1) consisting of an oil having a boiling point not lower than 538° C., asphaltene and pre-asphaltene; carbon dioxide and carbon monoxide gases (represented by $IOG_1$) in FIG. 1, water (represented by $IOG_2$ in FIG. 1), and ammonia and hydrogen sulfide (represented by $IOG_3$ in FIG. 1). Also, the coal excluding the ash component is classified into a component having a high liquefying reaction rate (represented by $C_A$ in FIG. 1, into a component having relatively low liquefying reaction rate (represented by $C_B$ in FIG. 1), and a component that scarcely performs reaction (represented by $C_I$ in FIG. 1). Also, a hydrogen gas (denoted by H in FIG. 1) is incorporated as a starting material. Reaction routes denoted by arrows were set among these components. Each of these reactions is a primary irreversible reaction that proceeds in only the direction denoted by the arrow at a rate proportional to the concentration of the starting materials. The reaction, the reaction route of which is not set in FIG. 1, scarcely proceeds and is regarded as being practically negligible.

In the reaction model, the coal is classified into three components of $C_A$, $C_B$ and $C_I$ on the basis of the technical idea obtained by the present inventors through experiments. The present inventors have found that the coal contains at least three kinds of components including a component that is rapidly converted into a liquefied product at temperatures not lower than about 400° C., a component that is slowly converted into the liquefied product, and a component whose conversion into the liquefied product is substantially negligible within a practical range of time, and that these three components differ from each other in the reaction route, too. Although the reaction rate somewhat differs depending on the kind of the coal, it is considered reasonable to classify that the primary irreversible reaction rate constant of the conversion reaction at 450° C. from the coal into the liquefied product is not lower than 0.5/min for the coal component $C_A$, lower than 0.5/min and not lower than $10^{-4}$/min for the coal component $C_B$, and less than $10^{-4}$/min for the coal component $C_I$.

The dependence of the reaction rate constant kij for each reaction route on the temperature is given by Arrhenius equation given below:

$$kij=k0ji*exp(-Eij/RT) \quad \text{[formula 10]}$$

where k0ij is called a frequency factor and Eij is called an activation energy, which are constants given for the individual reaction rate constants, R is a gas constant, and T is temperature. The present inventors have conducted experiments on various kinds of coals and found that the values of k0ij and Eij differ depending on the kinds of the coals. It has also been found that the ratios of the three components $C_A$, $C_B$ and $C_I$ of the coal also differ depending on the kinds of the coals. In other words, the reaction model shown in FIG. 1 can be applied to various kinds of coals by using the frequency factor, the activation energy and the component ratio, which differ depending on the kinds of coals.

One set of the reaction rate formula shown in Table 1 can be obtained from the reaction model shown in FIG. 1. The set of reaction rate formula is simultaneous differential equations of one exponent. By solving the simultaneous differential equations under the boundary conditions of the individual reaction apparatus, the yield of the liquefied product in the reaction apparatus can be obtained.

TABLE 1

| Simultaneous Differential Equations of One Exponent |
|---|
| m1/dt = −(k33 + k41 + k81)m1 |
| m2/dt = −k32m2 |
| m3/dt = k311m1 + k32m2 − k43m3 − k63m3 − k73m3 − k93m3 − k103m3 |

TABLE 1-continued

| Simultaneous Differential Equations of One Exponent |
|---|
| m4/dt = k41m1 + k43m3 − k54m4 |
| m5/dt = k54m4 |
| m6/dt = k63m3 |
| m7/dt = k73m3 |
| m8/dt = k81m1 |
| m9/dt = k93m3 |
| m10/dt = k103m3 |
| m11/dt = k113m3 |
| where |
| m1 = $[C_A]$ |
| m2 = $[C_B]$ |
| m3 = [PAAO] |
| m4 = $[O_3]$ |
| m5 = $[O_2]$ |
| m6 = $[O_1]$ |
| m7 = [OG] |
| m8 = $[IOG_1]$ |
| m9 = $[IOG_2]$ |
| m10 = $[IOG_3]$ |
| m11 = [H] |

where [M] is a nondimensional component ratio obtained by dividing the mass flow rate (kg/h) of the component M by the initial mass flow rate of the coal (kg/h: dry ash-free base).

The boundary conditions of the simultaneous differential equations of one exponent shown in Table 1 are determined by the type, size, temperature and pressure of the liquefying reaction apparatus. A majority of the coal liquefying reaction apparatuses assume the apparatus type of so-called "bubbling tower", in which a hydrogen gas is blown into a coal slurry under a high temperature and a high pressure so as to generate fine bubbles within the slurry. The present inventors have studied the operating conditions of the known coal liquefying reaction apparatuses of the bubbling tower type and found that the most of the reaction apparatuses can be regarded as a reactor that is called a complete mixing vessel type reactor in the reaction engineering. Therefore, in the present invention, the simultaneous differential equations of one exponent shown in Table 1 are solved under the boundary conditions of the bubbling tower reactor of a complete mixing vessel type.

In the reactor of a complete mixing vessel type, the temperature, pressure and composition within the reactor are uniform. Therefore, the composition within the reactor is equal to the composition of the effluent from the outlet of the reactor. If the residence time within the first reactor, i.e., the first bubbling tower, is set at $\tau$1, the simultaneous differential equations of one exponent shown in Table 1 can be integrated easily to give simultaneous equations given in Table 2.

TABLE 2

| Simultaneous Equations |
|---|
| m1,1 − m1,0 = (k31 + k41 + k81)m1,1S τ nS |
| m2,1 − m2,0 = k32m2,1S τ nS |
| m3,1 − m3,0 = (k31m1,1S + k32m2,1S − (k43 + k63 + k73 + k93 + k103)m3,1S τ nS |
| m4,1 − m4,0 = (k43m1,1S + k43m3,1S − k54m4,1S) τ nS |
| m5,1 − m5,0 = k54m4,1S τ nS |
| m6,1 − m6,0 = k63m3,1S τ nS |
| m7,1 − m7,0 = k73m3,1S τ nS |
| m8,1 − m8,0 = k81m1,1S τ nS |
| m9,1 − m9,0 = k93m3,1S τ nS |

TABLE 2-continued

| Simultaneous Equations |
|---|
| m10,1 − m10,0 = k103m3,1S τ nS |
| m11,1 − m11,0 = k113m3,1S τ nS |

where mi,n−1 represents the nondimensional component ratio of component i at the inlet of the n-th reactor;

mi,n represents the nondimensional component ratio of component i at the outlet of the n-th reactor; and mi,nS represents the nondimensional component ratio of component i present in the slurry phase.

The amount of presence within the slurry phase is taken in the nondimensional component ratio on the right term in each equation in Table 2. This is because a catalyst is required for carrying out the coal liquefying reaction. Since the catalyst is present only within the slurry phase, all the reactions shown in FIG. 1 are regarded as proceeding within the slurry phase, and the reaction is regarded as not proceeding within the gaseous phase. By the similar reason, the residence time τ1S within the slurry phase is regarded as the residence time.

Only the reaction rate constant kij and the component ratio mi,0 for each component at the inlet of the reactor are known in the simultaneous equations shown in Table 2. Also, the component ratio mi,1 for each component at the outlet of the reactor, the component ratio mi,1S for each component within the slurry, and the residence time τ1S within the slurry phase are unknown, though it is possible to obtain τ1S from the known empirical formula, if mi,1S is given. It is possible to obtain mi,1S from the gas-liquid equilibrium calculation, if mi,1 is given. It follows that mi,1 alone is the true independent variable within the simultaneous equations shown in Table 2.

However, since the gas-liquid equilibrium relationship is very complex, it is practically impossible to erase mi,1S and τ1S by substituting the gas-liquid equilibrium relationship in the simultaneous equations shown in Table 2.

Under the circumstances, the problem is solved in the method of the present invention as an optimizing problem provided with restricting conditions by a numeral analytical method by setting a target function. To be more specific, the problem is ascribed to the question of obtaining a variable vector X minimizing the target function F(x) of the optimizing problem represented as follows:

Target function: $F(X)$ [formula 11]

Restricting conditions: $C(X)=0$ $G(X)\geqq 0$ $L\leqq X\leqq U$

To be more specific, where the yield of the liquefied product of the bubbling tower reactor of a complete mixing vessel type is sought, the target function and the restricting conditions are set as follows:

Minimizing target function: $F(Xi)=\Sigma((mi,\mathbf{1})a-(mi,\mathbf{1})c)^2$ [formula 12]

Figure 3:
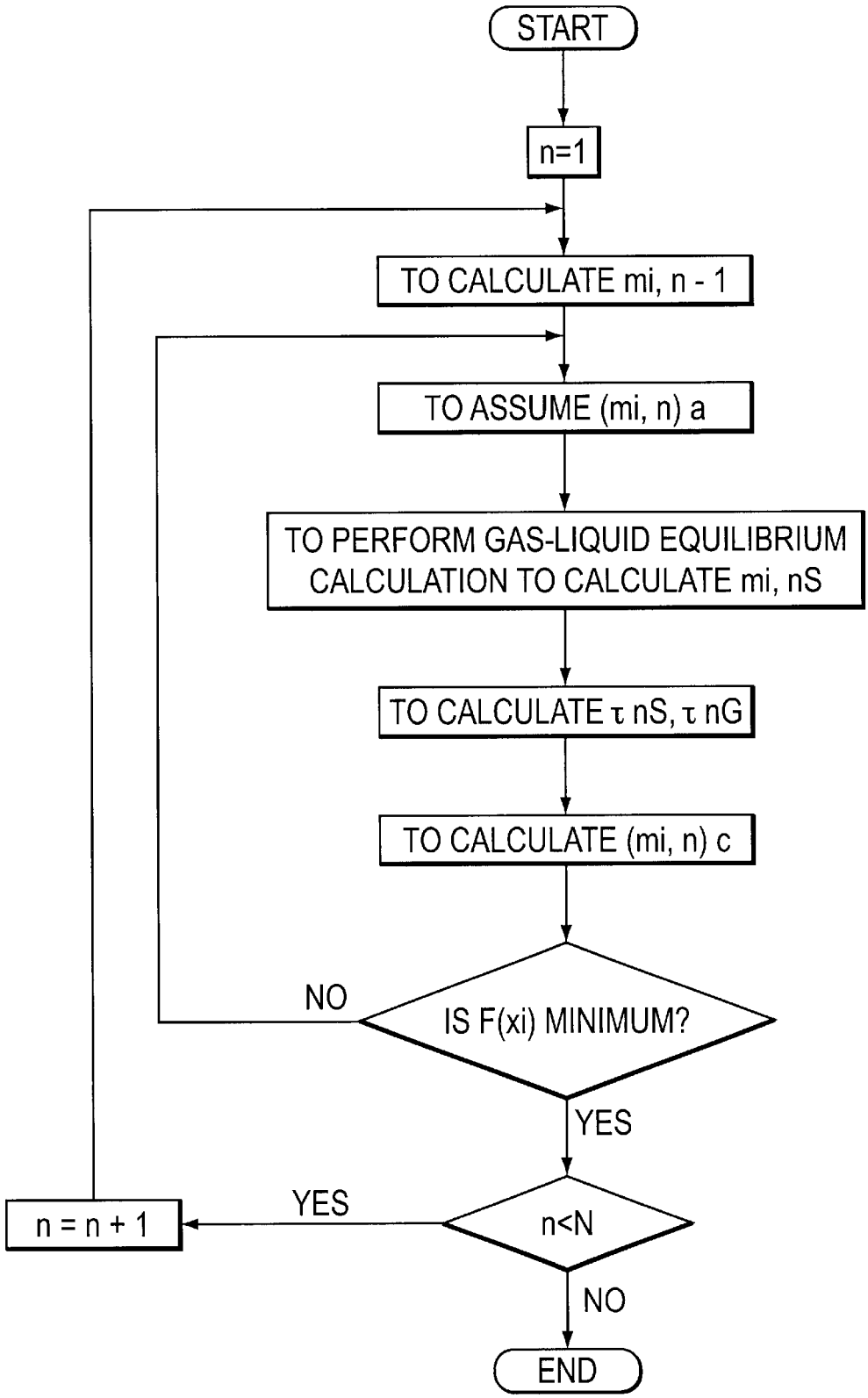
FIG. 3 shows the flow of the algorithm for calculating the effluent amount of the reaction tower.

Restricting conditions: $(mi,\mathbf{1})a-(mi,\mathbf{1})c=0(mi,\mathbf{1})c\geqq 0$ To be more specific, in the method of the present invention, the value of mi,1 is assumed first, followed by obtaining mi,1S by a gas-liquid a) equilibrium calculation with the assumed composition. Further, τ1S was obtained by calculating the gas hold up from an empirical formula. Then, mi,1 was calculated by substituting these mi,1S and τ1S in the simultaneous equations shown in Table 2. In most cases, the (mi,1)a assumed first and the calculated (mi,1)c do not coincide with each other. Therefore, calculation is performed again by newly assuming (mi,1)a in a manner to diminish the difference between the assumed value and the calculated value. This calculation loop is repeated until the target function is minimized so as to obtain the reactor outlet composition mi,1. The composition obtained by adding a hydrogen gas blown into the second bubbling tower to mi,1 is newly made mi,1 constituting an inlet composition of the second reactor, i.e., the second bubbling tower. Then, a repeating calculation similar to that in the first tower is performed so as to obtain the second tower outlet composition mi,2. At the same time, it is possible to obtain τ2S and the gaseous phase residence time τ2G. FIG. 3 shows the series of calculation algorithm described above.

How about the case where the reaction rate constant of the coal liquefying reaction is estimated from the actually measured value of the effluent amount for each component of the N-th vessel of a vessel column reactor operated under a high temperature and a high pressure? Where N=1, i.e., where the values of mi,0 and mi,1 are known, the composition ratio mi,1S for each component of the slurry phase can be obtained from the gas-liquid equilibrium calculation so as to determine the slurry phase residence time τ1S. It follows that the reaction rate constant kij can be obtained without conducting the repeated calculation.

Where N is not smaller than 2, i.e., $N\geqq 2$, however, mi,n($1\leqq n<N$) is unknown, making it impossible to know τnS. Under the circumstances, the problem is solved by an numeral value analyzing method as an optimizing problem provided with restricting conditions by setting a target function, as in the case of seeking the yield of the liquefied product of the bubbling tower reactor of a complete mixing vessel type. Further, the present inventors have found that, where the reaction rate constant is sought, there are two methods of resolution, i.e., an indirect method and a direct method, depending on the manner of taking the target function.

In the indirect method, the reaction rate constant to be sought is indirectly made an operation variable, and the function of the N-th bubbling tower reactor outlet flow rate mi,N is taken as the target function.

Minimizing target function:

$F(Xi(kij)=\Sigma((mi,N(kij)o-(mi,N\ kij))c)^2$ [formula 13]

Restricting conditions:

$(mi,N(kij)o-(mi,N(kij))c=0$ $kij\geqq 0$

In the indirect method, the reaction rate constant kij is obtained by using the calculation algorithm described below. In the first step, the value of kij is assumed to be, for example, the value of the reaction rate constant of the coal, whose reaction rate constant is known, having similar properties. The outlet flow rate mi,n of the n-th tower is successively calculated by using the assumed value (kij)a so as to finally obtain the outlet flow rate (mi,N) of the N-th tower. In this case, since the actually measured value (mi,N)o of the outlet flow rate for the N-th tower is known, the value of (mi,N)o is compared with the calculated value (mi,N)c, and the calculation is performed again by newly assuming kij in a manner to minimize the difference. This calculation loop is repeated until the target function is minimized so as to obtain the reaction rate constant kij.

Where N is equal to 2 (N=2), the calculation is rapidly converged in the indirect method. Where N is not smaller than 3, however, the number of local optimum solutions is large, making it difficult to arrive at the entire region optimum solution. Therefore, it is desirable to employ the direct method in the case where N is not smaller than 3, i.e., (N≧3).

In the direct method, the function of the reaction rate constant kij to be sought is taken as the target function.

Minimizing target function:

$$F(kij)=\Sigma((kij)a-(kij)c)^2 \quad \text{[formula 14]}$$

Restricting condition:

$$kij \geqq 0$$

In the direct method, the reaction rate constant kij is obtained by using the calculation algorithm described above. In the first step, the value of kij is assumed to be the value of the reaction rate constant of the coal, whose reaction rate constant is known, having similar properties. The outlet flow rate of the n-th tower is successively calculated by using the assumed value (kij)a so as to obtain mi, N−1. In this case, since the situation for the N-th tower is equal to that in the case where N=1, the reaction rate constant (kij)c can be obtained. F(kij) is calculated from (kij)c and (kij)a, and this calculation loop is repeated until the target function is minimized so as to obtain the reaction rate constant kij.

It has been found by the research conducted by the present inventors that the reaction constants k32, k43, k54, k63 and k10 are dependent on the product {(H/C)×VM} between the ratio (H/C) of hydrogen to carbon in the dry coal and the volatile component (VM) of the dry coal. It has also been that k73 in FIG. 1 is dependent on the product {(H/C)×(VM−O)} between the difference (VM−O) between the content of the volatile component VM and the oxygen content of the dry coal and the product of to H/C noted above, that both k103 and k81 in FIG. 1 are dependent on the product {(H/C)×O} between H/C and the oxygen content (O) of the dry coal, and that k93 in FIG. 1 is dependent on the nitrogen and sulfur content (N+O) of the dry coal.

Under the circumstances, the reaction rate constant kij for a plurality of kinds of coals differing from each other in the degree of coalification (carbon content) is obtained by using the calculation algorithm noted above so as to determine the relationship between the reaction rate constant kij and the components of the coal described above and, thus, to represent the reaction rate constant as a relationship (functional relationship) using the components of the coal as a parameter.

As a result, where coals of different kinds are liquefied, the reaction rate constant in the liquefying process of the coal can be easily obtained by analyzing the components of the coal and by substituting the analyzed value in the relationship. It follows that it is unnecessary to conduct a continuous demonstrating operation of a bench scale plant or a pilot plant, making it possible to markedly save the expenses and time required for the development of the coal liquefying process. It is also possible to study the operating conditions such as the selection of the kind of the raw material coal, the reaction temperature, the reaction pressure and the reaction time, leading to optimization of the shape of the reactor (reaction vessel).

The detailed calculation method of the present invention will now be described with reference to the following Examples.

Example 1

The estimation of the reactor outlet flow rate of a coal liquefying reactor consisting of three bubbling towers connected in series will now be exemplified by using the program of the present invention. The value of kij of the raw material coal A at the reaction temperature employed in this Example and the values of $[C_A]$, $[C_B]$ and $[C_I]$ have been obtained by experiments. Tables 3 and 4 show the size of the bubbling tower, the reaction temperature, the reaction pressure and the inlet flow rate Mi,0 of the first tower for each component:

TABLE 3 estimation result of bubbling tower outlet flow rate (small blowing amount of hydrogen gas)

| | first tower | | | second tower | | third tower | |
|---|---|---|---|---|---|---|---|
| reactor inner diameter cm | 100.0 | | | 100.0 | | 100.0 | |
| reactor effective length cm | 1100.0 | | | 1100.0 | | 1100.0 | |
| reactor inner volume L | 8640.0 | | | 8640.0 | | 8640.0 | |
| gas space velocity cm/s | 5.9 | | | 7.4 | | 7.5 | |
| slurry space velocity cm/s | 0.20 | | | 0.42 | | 0.03 | |
| gas hold-up — | 0.387 | | | 0.463 | | 0.466 | |
| slurry residence time sec | 3442 | | | 1407 | | 21918 | |
| reactor temperature ° C. | 476 | | | 576 | | 570 | |
| reactor pressure kg/cm$^2$ | 171 | | | 171 | | 171 | |
| blown hydrogen amount kg/h | 60.6 | | | 130.0 | | 5.4 | |
| flow rate kg/h | inlet (total amount) | outlet (total amount) | outlet (S phase) | outlet (total amount) | outlet (S phase) | outlet (total amount) | outlet (S phase) |
| C | 5106.3 | 849.6 | 849.6 | 6.2 | 6.2 | 0.0 | 0.0 |
| PAAO | 850.0 | 2684.1 | 2684.1 | 80.1 | 80.1 | 1.1 | 1.1 |
| $O_3$ | 4665.3 | 5309.2 | 3081.2 | 6378.0 | 0.0 | 6404.8 | 0.0 |
| $O_2$ | 4554.9 | 4874.8 | 1558.1 | 4874.9 | 0.0 | 4875.0 | 0.0 |
| $O_1$ | 293.2 | 997.2 | 182.7 | 2331.9 | 0.2 | 2414.0 | 0.0 |
| OG | 949.0 | 1396.8 | 52.0 | 2269.0 | 0.0 | 2464.0 | 0.0 |
| $IOG_1$ | 446.8 | 724.4 | 15.0 | 877.1 | 0.0 | 944.8 | 0.0 |
| $IOG_2$ | 246.8 | 512.2 | 1.5 | 1014.6 | 0.0 | 1027.7 | 0.0 |
| $IOG_3$ | 0.0 | 50.1 | 1.8 | 145.5 | 0.0 | 147.5 | 0.0 |
| H | 683.9 | 607.8 | 8.8 | 478.9 | 0.0 | 477.7 | 0.0 |

TABLE 4 estimation result of bubbling tower outlet flow rate (large blowing amount of hydrogen gas)

| | first tower | | | second tower | | third tower | |
|---|---|---|---|---|---|---|---|
| reactor inner diameter cm | 100.0 | | | 100.0 | | 100.0 | |
| reactor effective length cm | 1100.0 | | | 1100.0 | | 1100.0 | |
| reactor inner volume L | 8640.0 | | | 8640.0 | | 8640.0 | |
| gas space velocity cm/s | 6.4 | | | 8.8 | | 9.5 | |
| slurry space velocity cm/s | 0.45 | | | 1.12 | | 0.17 | |
| gas hold-up — | 0.410 | | | 0.534 | | 0.565 | |
| slurry residence time sec | 1449 | | | 458 | | 2816 | |
| reactor temperature ° C. | 450 | | | 450 | | 452 | |
| reactor pressure kg/cm$^2$ | 171 | | | 171 | | 171 | |
| blown hydrogen amount kg/h | 138.6 | | | 346.5 | | 34.0 | |
| flow rate kg/h | inlet (total amount) | outlet (total amount) | outlet (S phase) | outlet (total amount) | outlet (S phase) | outlet (total amount) | outlet (S phase) |
| C | 5106.3 | 937.6 | 937.2 | 308.2 | 308.2 | 90.2 | 90.2 |
| PAAO | 850.0 | 2786.4 | 2786.4 | 2093.3 | 2093.3 | 1292.6 | 1292.6 |
| $O_3$ | 4665.3 | 5253.9 | 3528.4 | 5391.9 | 2840.1 | 5452.5 | 2102.5 |
| $O_2$ | 4554.9 | 4871.7 | 1885.7 | 5140.6 | 1321.9 | 5396.2 | 932.4 |
| $O_1$ | 293.2 | 936.7 | 205.6 | 1478.5 | 198.4 | 2178.8 | 194.5 |
| OG | 949.0 | 1487.1 | 58.9 | 2296.1 | 51.7 | 3619.5 | 59.0 |
| $IOG_1$ | 446.8 | 772.7 | 16.2 | 1061.0 | 12.5 | 1503.2 | 13.1 |
| $IOG_2$ | 246.8 | 485.7 | 1.7 | 676.9 | 1.4 | 827.1 | 1.1 |
| $IOG_3$ | 0.0 | 45.0 | 1.7 | 80.7 | 1.7 | 108.8 | 1.7 |
| H | 683.9 | 699.7 | 9.9 | 949.1 | 7.5 | 906.3 | 5.4 |

In performing the gas-liquid equilibrium calculation, each of $O_1$, $O_2$ and $O_3$, which were mixtures, was handled as a hydrocarbon compound having a representative boiling point Tb, a density ρI and an average molecular weight Wi shown in Table 5.

TABLE 5

| | Tb(° C.) | ρ (g/cm$^3$) | W |
|---|---|---|---|
| $O_1$ | 210 | 0.939 | 134.4 |
| $O_2$ | 292 | 0.981 | 177.2 |
| $O_3$ | 392 | 1.074 | 236.0 |

An RKS method was used for calculating the gas-liquid equilibrium. Table 3 shows the values of the slurry phase outlet flow rate Mi, kS of each reaction tower.

The slurry phase residence time τnS can be calculated from Mi, kS and the volume Vs occupied by the slurry phase within the reactor.

$$\tau nS = Vs/\Sigma(Mi,\ kS/\sigma I) = VR(1-\epsilon g)/\Sigma(Mi,\ kS/\sigma I) \quad \text{[formula 15]}$$

where VR represents the entire reaction volume of the first bubbling tower, ϵg represents a value called gas hold-up, which is a ratio of the gas phase occupied in the entire reaction volume. Various empirical formulas are proposed as the method of estimating ϵg. In this Example, used was a corrected NEDOL formula given as formula 25.

$$\epsilon g = 0.195 UG^{0.8} Dt^{-0.3} \quad \text{[formula 16]}$$

where UG=gas space velocity (cm/sec)

Dt=tower diameter (cm)

Table 3 covers the case where a hydrogen gas was blown at a rate of 60 kg/h into the first tower, at a rate of 130 kg/h into the second tower, and at a rate of 5 kg/h into the third tower. In each of the second tower and the third tower, all the oil components of $O_1$ to $O_3$ were shifted into the gas phase so as to be put in a state of so-called "dry-up". Under this state, coking is brought about within the reactor and, thus, the particular state is very undesirable. Therefore, the hydrogen gas blowing amount was increased such that a hydrogen gas was blown at a rate of 138 kg/h into the first tower, at a rate of 346 kg/h into the second tower, and at rate of 34 kg/h into the third tower, as shown in Table 4. As a result, an appropriate slurry flow rate was obtained in each of these towers. Also, any of τn,S was put within one hour.

Example 2

The reaction rate constant was calculated on the basis of the actually measured data on the reactor outlet flow rate of the coal liquefying reactor consisting of three bubbling towers connected in series by using the program of the present invention. The values of $[C_A]$, $[C_B]$ and $[C_I]$ of the raw material coal were obtained by experiments conducted separately. Also, a slurry pre-heater was arranged in the front stage of the coal liquefying reactor so as to heat the slurry to a temperature close to the reaction temperature before the slurry enters the first reaction tower. In this pre-heating stage, the conversion reactions of CA into the liquefied product, i.e., the reactions of the three routes of $C_A \rightarrow O_3$, $C_A \rightarrow$PAAO, and $C_A \rightarrow IOG_1$, were substantially completed and, thus, these reactions were neglected in the analysis of the reaction rate. It follows that the values of k31, k41 and k81 were not obtained from the analysis of the reaction rate.

Table 6 shows the reaction rate constant of the coal B obtained by the analysis of the reaction rate. On the other hand, Table 7 shows the actually measured data used in the analysis of the reaction rate and the outlet flow rate of each bubbling tower obtained by using the reaction rate constant shown in Table 6.

TABLE 6

Reaction Rate Constant at 450° C. of Coal B

| | |
|---|---|
| k32 | 0.0446/min |
| k43 | 0.0025/min |
| k54 | 0.0026/min |

TABLE 6-continued

| Reaction Rate Constant at 450° C. of Coal B | |
|---|---|
| k63 | 0.0086/min |
| k73 | 0.0048/min |
| k93 | 0.0036/min |
| k103 | 0.0007/min |
| k113 | 0.0018/min |

TABLE 8

| kind of coal | Adaro coal | Tanitohalm coal | Ikeshima coal (80% load) |
|---|---|---|---|
| VM | 0.510 | 0.499 | 0.468 |
| FC | 0.490 | 0.501 | 0.532 |
| C | 0.742 | 0.759 | 0.818 |
| H | 0.052 | 0.058 | 0.061 |
| N | 0.009 | 0.018 | 0.014 |

TABLE 7 estimation result of bubbling tower outlet flow rate (verification of reaction rate constant)

| | first tower | | | second tower | | third tower | | |
|---|---|---|---|---|---|---|---|---|
| reactor inner diameter cm | 17.5 | | | 17.5 | | 17.5 | | |
| reactor effective length cm | 175.0 | | | 175.0 | | 175.0 | | |
| reactor inner volume L | 44.0 | | | 44.0 | | 44.0 | | |
| gas space velocity cm/s | 2.3 | | | 2.3 | | 2.2 | | |
| slurry space velocity cm/s | 0.09 | | | 0.08 | | 0.07 | | |
| gas hold-up — | 0.238 | | | 0.234 | | 0.230 | | |
| slurry residence time sec | 1549 | | | 1743 | | 1973 | | |
| reactor temperature ° C. | 450 | | | 450 | | 450 | | |
| reactor pressure kg/cm$^2$ | 171 | | | 171 | | 171 | | |
| blown hydrogen amount kg/h | 0.0 | | | 0.0 | | 0.0 | | |
| flow rate kg/h | inlet (total amount) | outlet (total amount) | outlet (S phase) | outlet (total amount) | outlet (S phase) | outlet (total amount) | outlet (S phase) | outlet (total amount) |
| C | 13.6 | 6.1 | 6.1 | 2.6 | 2.6 | 1.0 | 1.0 | 1.0 |
| PAAO | 13.5 | 14.0 | 14.0 | 11.3 | 11.2 | 7.9 | 7.9 | 8.6 |
| $O_3$ | 39.8 | 39.1 | 22.9 | 38.3 | 20.9 | 37.3 | 18.9 | 35.9 |
| $O_2$ | 36.3 | 37.9 | 9.9 | 39.5 | 9.5 | 41.1 | 8.9 | 41.9 |
| $O_1$ | 6.8 | 10.6 | 0.6 | 14.0 | 0.8 | 16.7 | 0.9 | 16.9 |
| OG | 6.6 | 7.6 | 0.2 | 8.6 | 0.2 | 9.3 | 0.2 | 9.3 |
| $IOG_1$ | 2.4 | 2.9 | 0.0 | 3.2 | 0.0 | 3.3 | 0.0 | 3.3 |
| $IOG_2$ | 0.7 | 2.0 | 0.0 | 3.2 | 0.0 | 4.2 | 0.0 | 4.2 |
| $IOG_3$ | 0.2 | 0.5 | 0.0 | 0.7 | 0.0 | 0.9 | 0.0 | 0.8 |
| H | 9.3 | 8.7 | 0.1 | 8.1 | 0.1 | 7.6 | 0.1 | 7.6 |

In Table 7, the inclined numerals represent the actually measured data. The estimated value and the experimental data well coincide with each other in respect of the outlet flow rate of the third tower, supporting that the reaction rate constant shown in Table 6 reproduces the liquefying characteristics of coal B with a high fidelity.

Example 3

Among the reaction rate constants shown in Table 1, the reaction rate constants k32, k43, k54, k63, k73, k103, k93, k81 and k10 were obtained by the calculation algorithm by the direct method described above on the basis of the reaction model shown in FIG. 1 by using a reactor consisting of three bubbling towers (reaction vessels) connected in series in respect of Adaro coal, which is a brown coal, Tanitohalm coal, which is a subbituminous coal having a high degree of coalification, and Ikeshima coal, which is a bituminous coal.

Table 8 shows the analytical values of the components of each of Adaro coal, Tanitohalm coal and Ikeshima coal, and the reaction rate constants obtained by the reaction model referred to previously and the calculation algorithm by actually measuring the components obtained by the liquefying reaction treatment.

TABLE 8-continued

| kind of coal | Adaro coal | Tanitohalm coal | Ikeshima coal (80% load) |
|---|---|---|---|
| S | 0 | 0.002 | 0.014 |
| O (diff.) | 0.197 | 0.163 | 0.093 |
| H/C | 0.84 | 0.92 | 0.89 |
| H/C × VM | 0.428 | 0.459 | 0.417 |
| H/C × (VM − O) | 0.263 | 0.309 | 0.334 |
| H/C × O | 0.165 | 0.150 | 0.083 |
| H/C × (N + S) | 0.0076 | 0.018 | 0.025 |
| C × O | 0.146 | 0.123 | 0.076 |
| $C_A$ | 0.544 | 0.558 | 0.490 |
| $C_B + C_I$ | 0.383 | 0.399 | 0.474 |
| PAAO | 0.023 | 0.024 | 0.021 |
| $O_3$ | 0.050 | 0.019 | 0.015 |
| K32 (1/sec) | 0.000956 | 0.000783 | 0.00140 |
| K43 | 0.0000378 | 0.0000770 | 0.0000282 |
| K54 | 0.0000253 | 0.0000685 | 0.0000220 |
| K63 | 0.0000909 | 0.000132 | 0.0000652 |
| K73 | 0.000107 | 0.0000782 | 0.0000674 |
| K103 | 0.0000503 | 0.0000532 | 0.0000217 |
| K93 | 0.0000046 | 0.0000072 | 0.0000083 |
| K81 | 0.0000605 | 0.0000740 | 0.0000116 |
| K10 | 0.0000218 | 0.0000255 | 0.0000138 |

"VM" in the first column of Table 8 denotes the ratio of the dimensionless volatile component contained in the dry coal. Also, "FC" denotes the ratio of the non-volatile carbon. These ratios have been determined by the industrial analysis. Also, C, H, N, O, S in the second column represent the weight ratios (dimensionless) of carbon, hydrogen, nitrogen, sulfur and oxygen contained in the dry coal. These weight ratios have been determined by the elemental analysis. Also, the parameters for calculating the reaction rate constant, which have been determined from the values given in the first and second columns, are given in the third column of Table 8. Incidentally, "H/C" represents the ratio of the hydrogen atom to the carbon atom in the dry coal. The carbon atom was obtained by dividing the values of C in the second column by 12.

The values of $C_A$, $C_B$, $C_I$ and PAAO in the fourth column, which correspond respectively to $C_A$, $C_B$, $C_I$ and PAAO shown in FIG. 1, have been obtained by experiments. Further, the reaction rate constants obtained by the theoretical simulation performed by using the reaction model noted above are shown in the fifth column of Table 8.

Figure 4:
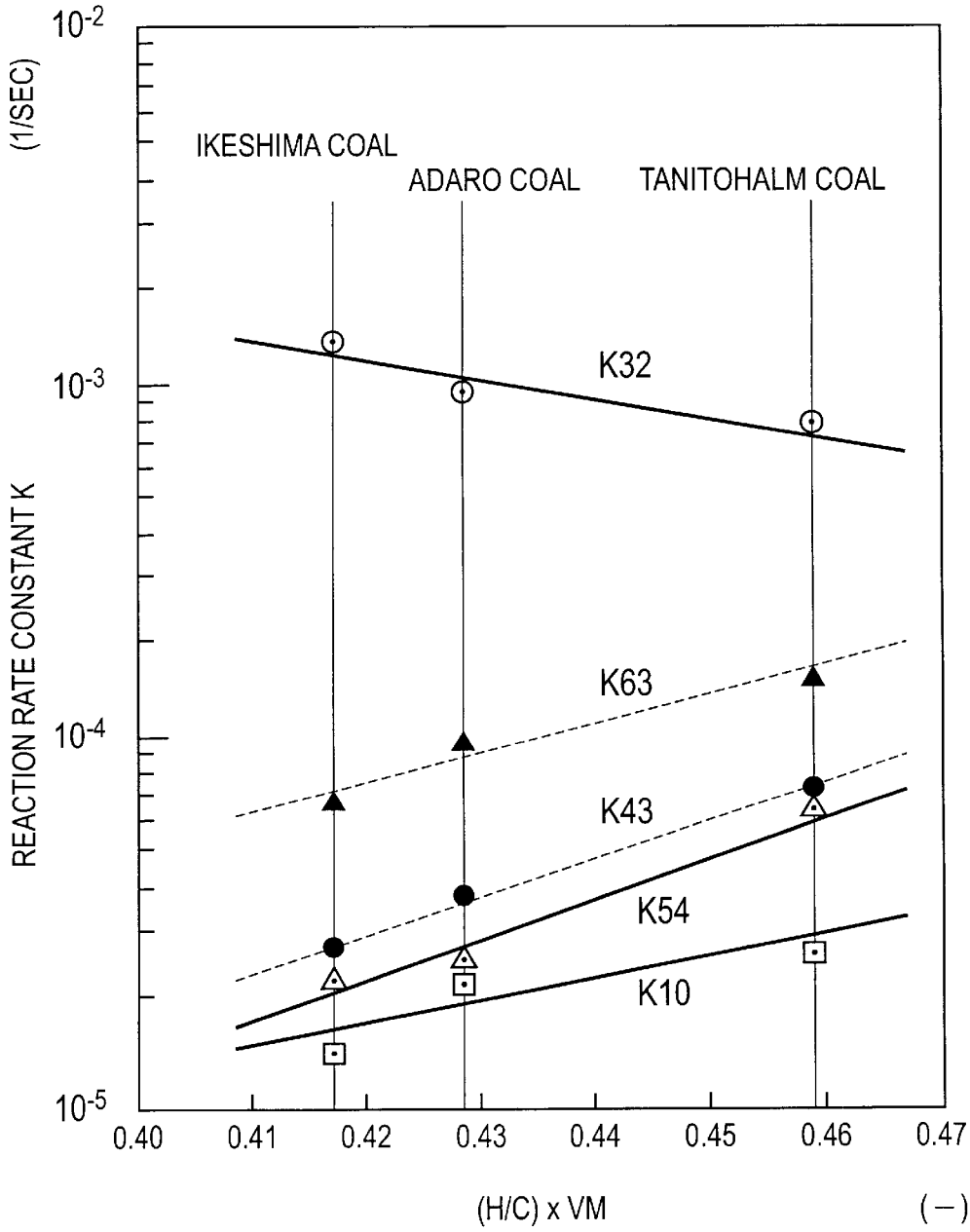
FIG. 4 is a graph showing the relationship between the product of the ratio of hydrogen atom to the carbon atom in the coal and the volatile component and K32, K43, K54, K63, K10 shown in FIG. 1.

Among these reaction rate constants, those of K32, K43, K54, K63 and K10 are plotted in a graph of FIG. 4, in which (H/C)×VM is plotted on the abscissa, and the reaction rate constant K is plotted in a logarithmic scale on the ordinate. The formulas of the straight lines showing the relationship between K32, K43, K54, K63, K10 and (H/C)×VM, which have been obtained on the basis of these plotted points, are as given below:

$$K32=K32_0\times10^{A32\{(H/C)\times VM\}+B32} \quad \text{[formula 17]}$$

$$K43=K43_0\times10^{A43\{(H/C)\times VM\}+B43} \quad \text{[formula 18]}$$

$$K54=K54_0\times10^{A54\{(H/C)\times VM\}+B54} \quad \text{[formula 19]}$$

$$K63=K63_0\times10^{A63\{(H/C)\times VM\}+B63} \quad \text{[formula 20]}$$

$$K10=K10_0\times10^{A10\{(H/C)\times VM\}+B10} \quad \text{[formula 21]}$$

where An represents the inclination of the straight line, and Bn denotes the intercept across the ordinate at (H/C)×VM=0. In this Example, however, Bn is obtained by using as $Kn_0$ the reaction rate constant at the intersection between the ordinate at the position corresponding to (H/C)×VM of the Tanitohalm coal shown in FIG. 4 and the straight line of Kn. This is also the case with the formulas for obtaining the other reaction rate constants described below.

The formulas of K32, K43, K54, K63 and K10 thus obtained are as given below:

$$K32=0.00070\times10^{-6.0\{(H/C)\times VM\}}+2.75 \quad \text{[formula 22]}$$

$$K43=0.000077\times10^{10.5\{(H/C)\times VM\}}-4.82 \quad \text{[formula 23]}$$

$$K54=0.000066\times10^{12.3\{(H/C)\times VM\}}-5.65 \quad \text{[formula 24]}$$

$$K63=0.00014\times10^{7.17\{(H/C)\times VM\}}-3.29 \quad \text{[formula 25]}$$

$$K10=0.000026\times10^{4.88\{(H/C)\times VM\}}-2.24 \quad \text{[formula 26]}$$

Figure 5:
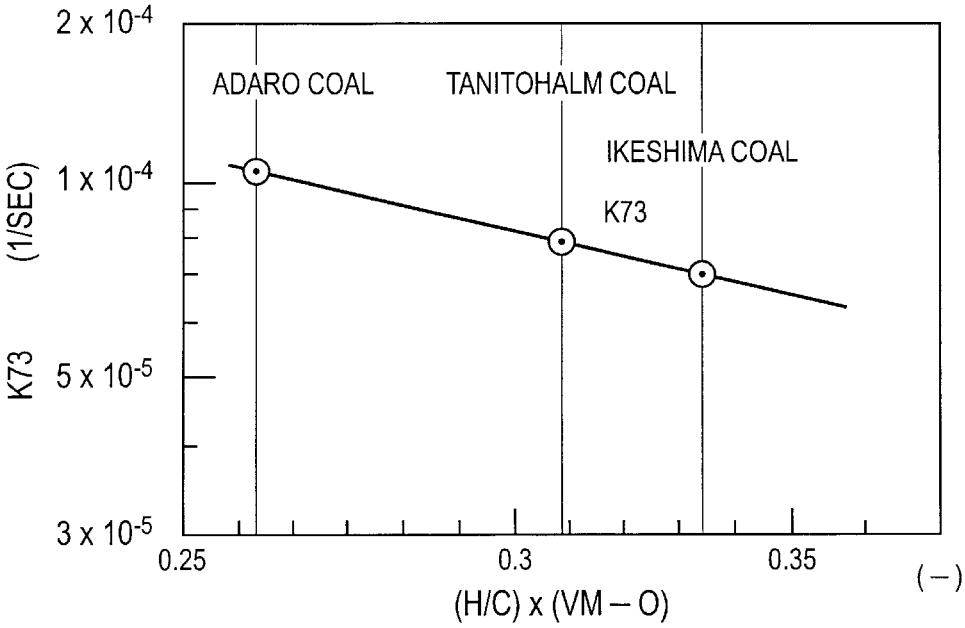
FIG. 5 is a graph showing the relationship between the product of the ratio of the hydrogen atom to the carbon atom contained in the dry coal and the difference between the volatile component content and the oxygen content and K73 shown in FIG. 1.

Also, the K73 shown in Table 8 can be plotted as shown in a graph of FIG. 5, in which (H/C)×(VM−0) is plotted on the abscissa, and the reaction rate constant is plotted in a logarithmic scale on the ordinate.

The relationship between K73 and (H/C)×(VM−0) can be obtained from FIG. 5 as given below:

$$K73=K73_0\times10^{A73\{(H/C)\times(VM-O\}+B73} \quad \text{[formula 27]}$$

where A73 represents the inclination of the straight line, with B73 representing the intercept across the ordinate. The value of B73 can be obtained as described previously by substituting the value of Tanitohalm coal on the straight line K73 in the coefficient $K73_0$ as given below:

$$K73=0.000078\times10^{-2.82\{(H/C)\times(VM-0)\}}+0.871 \quad \text{[formula 28]}$$

Figure 6:
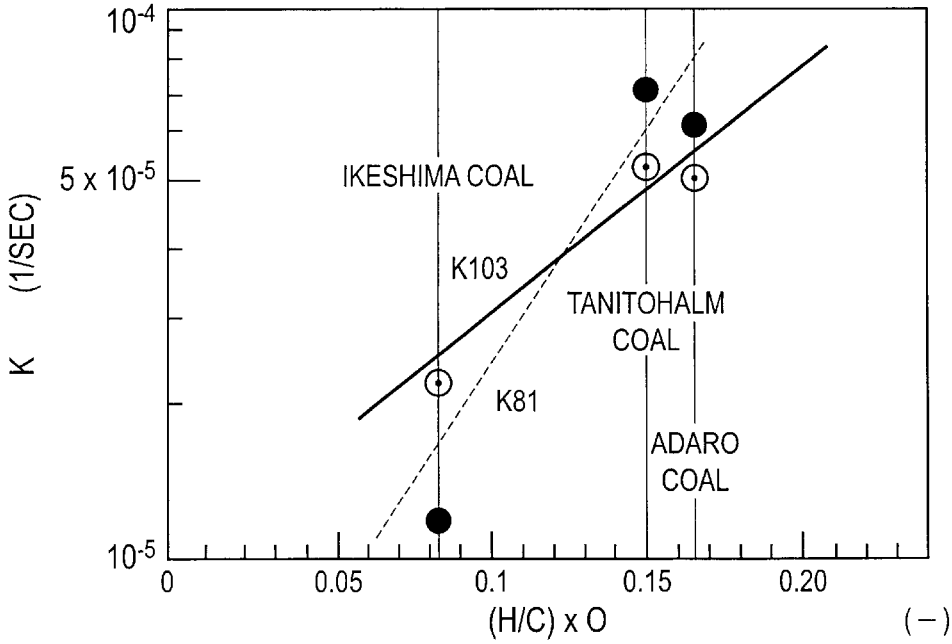
FIG. 6 is a graph showing the relationship between the product of the ratio of the hydrogen atom to the carbon atom in the dry coal and the oxygen content and K103, K81 shown in FIG. 1.

Further, K103 and K81 are as shown in a graph of FIG. 6, in which (H/C)×O is plotted on the abscissa, and the reaction rate constant is plotted in a logarithmic scale on the ordinate. The formulas of the straight lines for K103 and K81, which are obtained as described previously, are as given below:

$$K103=K103_0\times10^{A103\{((H/C)\times O\}+B103} \quad \text{[formula 29]}$$

$$K81=K81_0\times10^{A81\{(H/C)\times O\}+B81} \quad \text{[formula 30]}$$

Similarly, the following values can be obtained:

$$K103=0.000048\times10^{4.20\{(H/C)\times O\}-0.630} \quad \text{[formula 31]}$$

$$K81=0.000058\times10^{8.0\{(H/C)\times O\}-1.20} \quad \text{[formula 32]}$$

Figure 7:
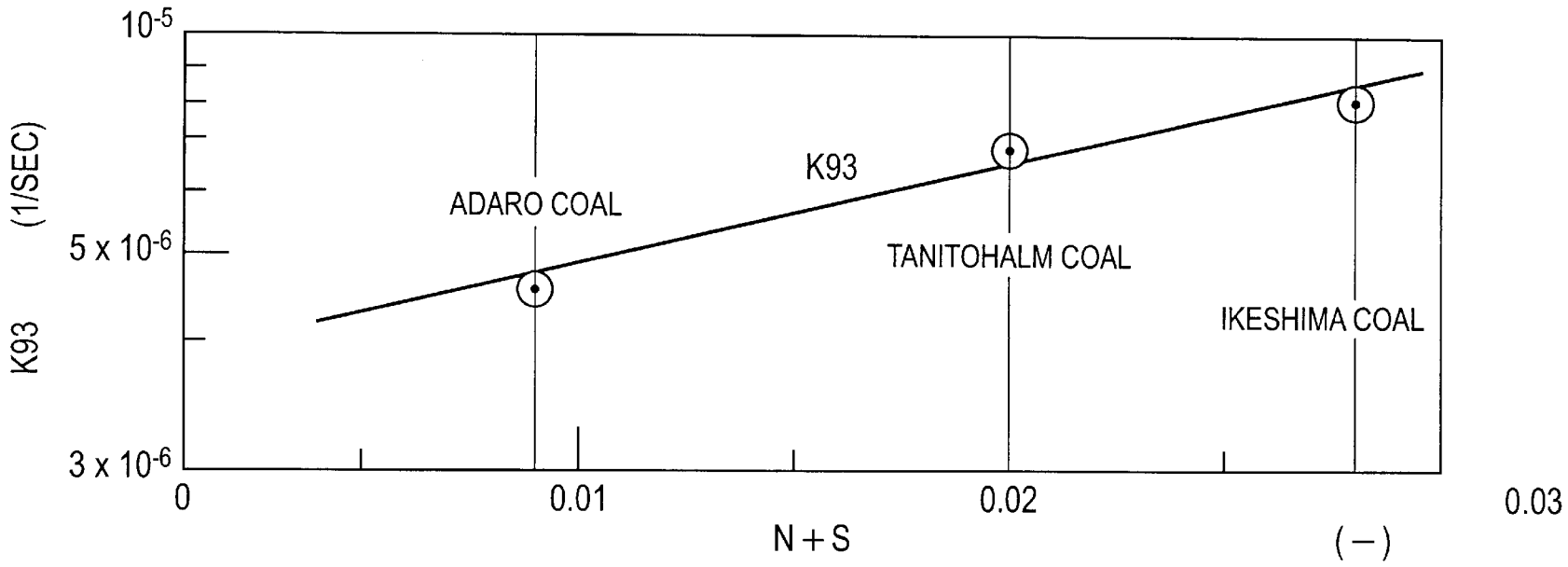
FIG. 7 is a graph showing the relationship between the sum of the nitrogen content and the sulfur content of the dry coal and K93 shown in FIG. 1.

Similarly, K93 shown in Table 8 can be represented as shown in a graph of FIG. 7, in which N+S is plotted on the abscissa, and the reaction rate constant is plotted in a logarithmic scale on the ordinate. Therefore, the relationship given below can be obtained:

$$K93=K93_0\times10^{A93\{N+S)+B93} \quad \text{[formula 33]}$$

Also obtained is:

$$K93=0.0000072\times10^{14.4(N+S)-0.288} \quad \text{[formula 34]}$$

Table 9 shows the reaction rate constants K32, K43, K54, K63, K73, K103, K93, K81 and K10 which are analytically obtained and shown in the fifth column of Table 8 in comparison with the reaction rate constants a (calculated values of the relationship) obtained by substituting the parameters shown in the third column of Table 8 in the relationship thus obtained for calculating the reaction rate constant. The analytical values and the calculated values of the reaction rate constant somewhat differ from each other. However, the difference is of no practical problem.

TABLE 9

| | | analytical value | calculated value of relationship |
|---|---|---|---|
| Adaro coal | K32 | 0.000956 | 0.00107 |
| | K43 | 0.0000378 | 0.000036 |
| | K54 | 0.0000253 | 0.000027 |
| | K63 | 0.0000909 | 0.000084 |
| | K73 | 0.000107 | 0.000105 |
| | K103 | 0.0000503 | 0.000055 |
| | K93 | 0.0000046 | 0.0000050 |
| | K81 | 0.0000605 | 0.000076 |
| | K10 | 0.0000218 | 0.000018 |
| Tanitohalm coal | K32 | 0.000783 | 0.00070 |
| | K43 | 0.0000770 | 0.000077 |
| | K54 | 0.0000685 | 0.000064 |
| | K63 | 0.000132 | 0.00014 |
| | K73 | 0.0000782 | 0.000078 |
| | K103 | 0.0000532 | 0.000048 |
| | K93 | 0.0000072 | 0.0000072 |
| | K81 | 0.0000740 | 0.000058 |
| | K10 | 0.0000255 | 0.000026 |
| Ikeshima coal | K32 | 0.00140 | 0.00124 |
| | K43 | 0.0000282 | 0.000028 |
| | K54 | 0.0000220 | 0.000020 |
| | K63 | 0.0000652 | 0.000070 |
| | K73 | 0.0000674 | 0.000066 |
| | K103 | 0.0000217 | 0.000025 |
| | K93 | 0.0000083 | 0.0000094 |
| | K81 | 0.0000116 | 0.000017 |
| | K10 | 0.0000138 | 0.000016 |

Then, the coal liquefying reaction was subjected to a simulation analysis by applying the reaction rate constant shown in the right column of Table 9, which was obtained by the calculation of the relationship given above, to the reaction model shown in FIG. 1 by using a coal liquefying reactor consisting of three bubbling towers connected in series in respect of each of Adaro coal, Tanitohalm coal and Ikeshima coal so as to estimate the final products and to compare the estimated final products with the measured values of the actually obtained final products. It should be noted, however, that the reactions of $C_A \rightarrow$PAAO and $C_A \rightarrow O_3$ shown in FIG. 1 were neglected as in the Examples described previously. Also, the slurry used was prepared by dispersing finely pulverized coal in a hydrocarbon solvent such as tetralin and contained 45% by weight of the coal and 3% by weight of the natural pearlite used as a catalyst.

Figure 8:
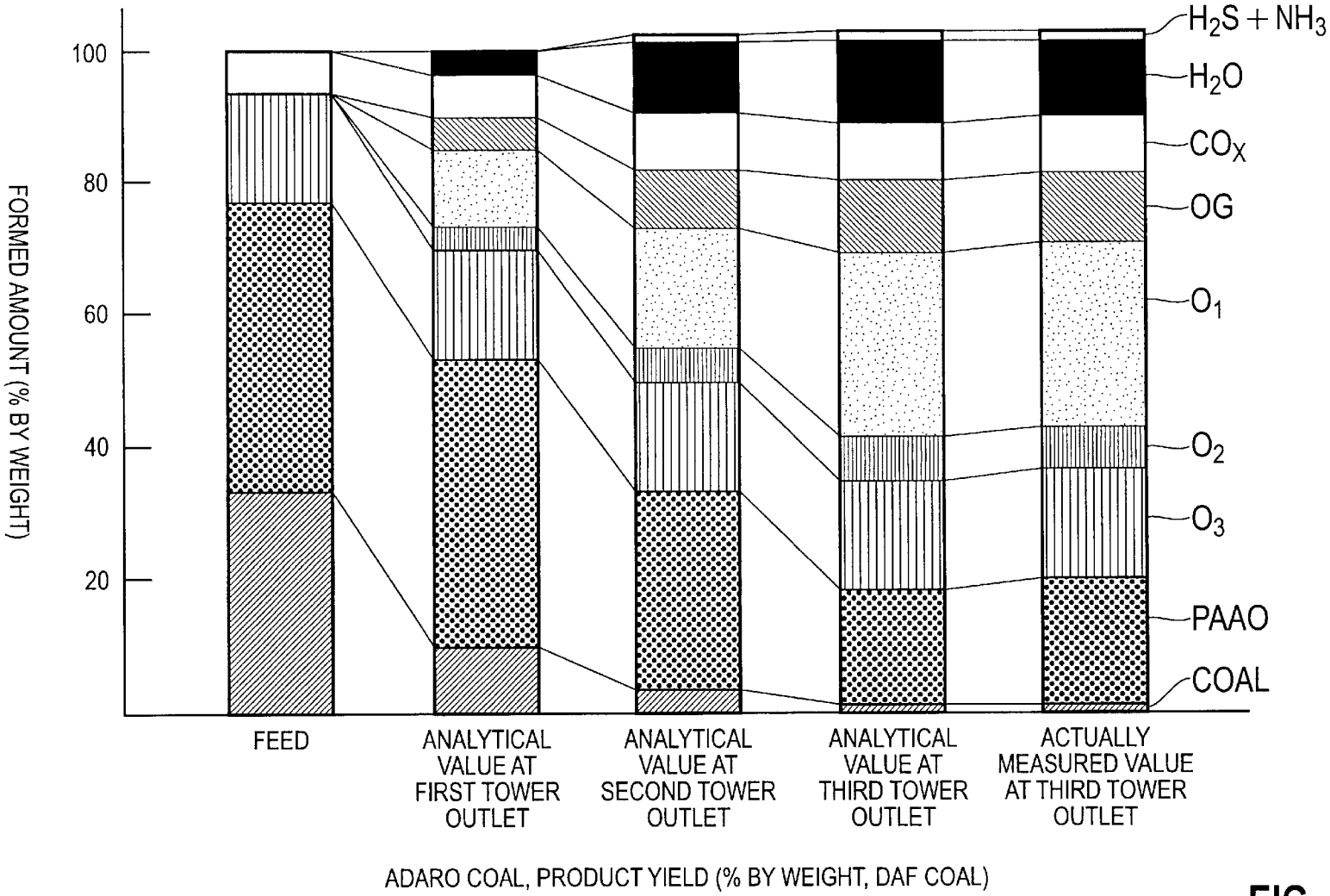
FIG. 8 is a graph showing the relationship between the product yield analyzed by using the reaction rate constant obtained by the relationship specified in the present invention and the actually measured product yield in respect of Adaro coal.

Table 10 shows the size of the reactor (reaction vessel) used for liquefying Adaro coal, the analyzed reaction time, the enthalpy difference, the heat dissipation amount, etc. Also, Tables 11 to 13 show the estimated values for each component at the reactor inlet (first tower inlet), the estimated values for each component at the first tower outlet, and the estimated values for each component at the second tower outlet in respect of Adaro coal. Table 14 shows the estimated values and the actually measured values for each component of the effluent at the outlet of the third tower in respect of Adaro coal. Further, FIG. 8 shows the analytical values of the effluent (product yield) at each of the reaction towers and the actually measured values at the outlet of the third tower in respect of Adaro coal.

TABLE 10

| | Adaro coal | | | | |
|---|---|---|---|---|---|
| | first tower | second tower | third tower | | |
| reaction tower L/D | 10.900 | 10.900 | 10.900 | | |
| reaction tower inner diameter D (cm) | 100.000 | 100.000 | 100.000 | | |
| reaction tower effective length L (cm) | 1090.000 | 1090.000 | 1090.000 | | |
| reactor inner volume (L) | 8561.000 | 8561.000 | 8561.000 | | |
| gas space velocity (cm/s) | 6.339 | 7.213 | 7.579 | | |
| liquid space velocity (cm/s) | 0.292 | 0.195 | 0.141 | | |
| mixing diffusion coefficient ($cm^2/s$) | 2964.690 | 3081.721 | 3127.807 | | |
| Peclet number | 0.107 | 0.069 | 0.049 | | |
| gas hold-up Eg | 0.518 | 0.573 | 0.596 | | |
| reaction time (s) | 1799.809 | 2382.601 | 3111.572 | sum of reaction time (s) | 7294 |
| enthalpy difference (kcal/hr) | 874841 | −272050 | −536523 | sum of enthalpy difference (kcal/hr) | 66269 |
| heat dissipation amount (kcal/hr) | 62745 | 60446 | 58101 | sum of heat dissipation amount (kcal/hr) | 181292 |

TABLE 11

| estimated value at inlet of first tower (Adaro coal) | | | | |
|---|---|---|---|---|
| | | estimated value at inlet of first tower | | |
| | | total influent | Vapor flow rate | Slurry flow rate |
| temperature ° C. | | 390.00 | 390.00 | 390.00 |
| pressure $Kg/cm^2$ A | | 172.43 | 172.43 | 172.43 |
| (kg/hr) | | | | |
| coal flow rate ($C_A + C_B + C_I$) | | 1864.40 | — | 1864.40 |
| PAAO | P | 2337.80 | — | 2337.80 |
| 350~538 oil | $O_3$ | 3441.20 | 267.92 | 3173.27 |
| 220~350 oil | $O_2$ | 4248.90 | 1668.42 | 2580.48 |
| $C_4$~220 oil | $O_1$ | 272.30 | 204.16 | 68.14 |
| $C_1$–$C_3$ hydrocarbon | OG | 860.80 | 832.97 | 27.83 |
| $CO + CO_2$ | $IOG_1$ | 1021.50 | 999.60 | 21.90 |
| $H_2O$ | $IOG_2$ | 326.60 | 324.33 | 2.27 |
| $H_2S + NH_3$ | $IOG_3$ | 53.70 | 51.47 | 2.23 |
| nitrogen | | 53.50 | 52.72 | 0.78 |
| hydrogen | H | 702.70 | 694.49 | 8.21 |
| catalyst + ash | | 243.90 | 0.00 | 243.90 |
| total amount of reactants | M | 15427.30 | 5096.08 | 10331.21 |
| volume flow rate of reactants | V (L/hr) | 165952.11 | 153959.90 | 11992.21 |
| (kmol/hr) | | | | |
| coal flow rate | C | — | — | — |
| PAAO | P | — | — | — |
| 350~538 oil | $O_3$ | 13.75 | 1.07 | 12.68 |
| 220~350 oil | $O_2$ | 22.28 | 8.75 | 13.53 |
| $C_4$~220 oil | $O_1$ | 2.99 | 2.43 | 0.55 |
| $C_1$–$C_3$ hydrocarbon | OG | 36.98 | 35.92 | 1.06 |
| $CO + CO_2$ | $IOG_1$ | 28.19 | 27.62 | 0.57 |
| $H_2O$ | $IOG_2$ | 18.13 | 18.00 | 0.13 |
| $H_2S + NH_3$ | $IOG_3$ | 1.58 | 1.51 | 0.07 |
| nitrogen | | 1.91 | 1.88 | 0.03 |
| hydrogen | H | 348.58 | 344.51 | 4.07 |
| catalyst + ash | | — | — | — |
| total amount of reactants | M | 474.39 | 441.70 | 32.68 |

TABLE 11-continued

| estimated value at inlet of first tower (Adaro coal) | | | | |
|---|---|---|---|---|
| | | estimated value at inlet of first tower | | |
| | | total influent | Vapor flow rate | Slurry flow rate |
| Enthalpy | kcal/hr | −1248300 | | |
| Enthalpy (coal + PAA) | kcal/hr | −1978800 | | |
| Total Enthalpy | kcal/hr | −3227100 | | |

TABLE 12

| estimated value at outlet of first tower (Adaro coal) | | | | | |
|---|---|---|---|---|---|
| | | estimated value at outlet of first tower | | | |
| | | total effluent | Vapor flow rate | Slurry flow rate | cooling gas |
| temperature ° C. | | 448.40 | 448.40 | 448.40 | 32.90 |
| pressure Kg/cm$^2$ A | | 172.03 | 172.03 | 172.03 | 174.00 |
| (kg/hr) | | | | | |
| coal flow rate ($C_A$ + $C_B$ +$C_I$) | | 612.47 | — | 612.47 | 0.00 |
| PAAO | P | 2361.92 | — | 2361.92 | 0.00 |
| 350~538 oil | $O_3$ | 3486.28 | 1242.56 | 2243.72 | 0.00 |
| 220~350 oil | $O_2$ | 4359.84 | 3173.95 | 1185.89 | 0.00 |
| $C_4$~220 oil | $O_1$ | 817.03 | 730.86 | 86.17 | 6.00 |
| $C_1$–$C_3$ hydrocarbon | OG | 1168.91 | 1147.31 | 21.60 | 40.00 |
| CO + $CO_2$ | $IOG_1$ | 1135.64 | 1120.83 | 14.81 | 29.10 |
| $H_2O$ | $IOG_2$ | 563.61 | 562.36 | 1.25 | 0.00 |
| $H_2S$ + $NH_3$ | $IOG_3$ | 77.46 | 75.70 | 1.75 | 2.50 |
| nitrogen | | 56.00 | 55.45 | 0.55 | 2.50 |
| hydrogen | H | 660.75 | 655.33 | 5.42 | 36.40 |
| catalyst + ash | | 243.90 | 0.00 | 243.90 | 0.00 |
| total amount of reactants | M | 15543.80 | 8764.35 | 6779.45 | 116.50 |
| volume flow rate of reactants | V (L/hr) | 187490.01 | 179243.80 | 8246.21 | 3414.00 |
| (kmol/hr) | | | | | |
| coal flow rate | C | — | — | — | — |
| PAAO | P | — | — | — | — |
| 350~538 oil | $O_3$ | 13.93 | 4.96 | 8.96 | 0.00 |
| 220~350 oil | $O_2$ | 22.86 | 16.64 | 6.22 | 0.00 |
| $C_4$~220 oil | $O_1$ | 8.79 | 8.08 | 0.71 | 0.10 |
| $C_1$–$C_3$ hydrocarbon | OG | 49.27 | 48.44 | 0.83 | 1.72 |
| CO + $CO_2$ | $IOG_1$ | 31.45 | 31.06 | 0.39 | 0.77 |
| $H_2O$ | $IOG_2$ | 31.28 | 31.22 | 0.07 | 0.00 |
| $H_2S$ + $NH_3$ | $IOG_3$ | 2.58 | 2.53 | 0.06 | 0.07 |
| nitrogen | | 2.00 | 1.98 | 0.02 | 0.09 |
| hydrogen | H | 327.77 | 325.09 | 2.69 | 18.06 |
| catalyst + ash | | — | — | — | — |
| total amount of reactants | M | 489.94 | 469.99 | 19.94 | 20.82 |
| Enthalpy | kcal/hr | −1818100 | | | −87561 |
| Enthalpy (coal + PAA) | kcal/hr | −621720 | | | 0 |
| Total Enthalpy | kcal/hr | −2439820 | | | −87561 |

TABLE 13

| estimated value at outlet of second tower (Adaro coal) | | | | | |
|---|---|---|---|---|---|
| | | estimated value at outlet of second tower | | | |
| | | total effluent | Vapor flow rate | Slurry flow rate | cooling gas |
| temperature ° C. | | 458.10 | 458.10 | 458.10 | 32.90 |
| pressure Kg/cm$^2$ A | | 171.63 | 171.63 | 171.63 | 174.00 |
| (kg/hr) | | | | | |
| coal flow rate ($C_A$ + $C_B$ +$C_I$) | | 165.26 | — | 165.26 | 0.00 |
| PAAO | P | 1693.82 | — | 1693.82 | 0.00 |
| 350~538 oil | $O_3$ | 3531.54 | 1960.01 | 1571.53 | 0.00 |
| 220~350 oil | $O_2$ | 4462.70 | 3773.49 | 689.21 | 0.00 |
| $C_4$~220 oil | $O_1$ | 1345.90 | 1267.02 | 78.88 | 17.40 |
| $C_1$–$C_3$ hydrocarbon | OG | 1541.45 | 1524.52 | 16.92 | 118.00 |
| CO + $CO_2$ | $IOG_1$ | 1251.91 | 1242.08 | 9.83 | 85.90 |

TABLE 13-continued estimated value at outlet of second tower (Adaro coal)

| | | estimated value at outlet of second tower | | | |
|---|---|---|---|---|---|
| | | total effluent | Vapor flow rate | Slurry flow rate | cooling gas |
| $H_2O$ | $IOG_2$ | 788.62 | 787.71 | 0.91 | 0.00 |
| $H_2S + NH_3$ | $IOG_3$ | 105.04 | 103.64 | 1.40 | 7.40 |
| nitrogen | | 63.40 | 63.02 | 0.38 | 7.40 |
| hydrogen | H | 684.87 | 681.40 | 3.47 | 98.50 |
| catalyst + ash | | 243.90 | 0.00 | 243.90 | 0.00 |
| total amount of reactants | M | 15878.40 | 11402.89 | 4475.51 | 334.60 |
| volume flow rate of reactants | V (L/hr) | 209454.66 | 203934.70 | 5519.96 | 9341.19 |
| (kmol/hr) | | | | | |
| coal flow rate | C | — | — | — | — |
| PAAO | P | — | — | — | — |
| 350~538 oil | $O_3$ | 14.11 | 7.83 | 6.28 | 0.00 |
| 220~350 oil | $O_2$ | 23.40 | 19.79 | 3.61 | 0.00 |
| $C_4$~220 oil | $O_1$ | 14.50 | 13.84 | 0.65 | 0.30 |
| $C_1$–$C_3$ hydrocarbon | OG | 64.38 | 63.73 | 0.65 | 5.07 |
| $CO + CO_2$ | $IOG_1$ | 34.62 | 34.36 | 0.26 | 2.28 |
| $H_2O$ | $IOG_2$ | 43.77 | 43.72 | 0.05 | 0.00 |
| $H_2S + NH_3$ | $IOG_3$ | 3.69 | 3.64 | 0.05 | 0.22 |
| nitrogen | | 2.26 | 2.25 | 0.01 | 0.26 |
| hydrogen | H | 339.74 | 338.02 | 1.72 | 48.86 |
| catalyst + ash | | — | — | — | — |
| total amount of reactants | M | 540.47 | 527.18 | 13.28 | 57.00 |
| Enthalpy | kcal/hr | −2790200 | | | −258690 |
| Enthalpy (coal + PAA) | kcal/hr | −180360 | | | 0 |
| Total Enthalpy | kcal/hr | −2970560 | | | −258690 |

TABLE 14 estimated value and actually measured value at outlet of third tower (Adaro coal)

| | | outlet of third tower | | | | |
|---|---|---|---|---|---|---|
| | | estimated value | | | | measured value |
| | | total effluent | Vapor flow rate | Slurry flow rate | cooling gas | total effluent |
| temperature ° C. | | 458.20 | 458.20 | 458.20 | 32.90 | |
| pressure $Kg/cm^2$ A | | 171.13 | 171.13 | 171.13 | 174.00 | |
| (kg/hr) | | | | | | |
| coal flow rate ($C_A + C_B + C_I$) | | 36.45 | — | 36.45 | 0.00 | 53.30 |
| PAAO | P | 987.68 | — | 987.68 | 0.00 | 1066.50 |
| 350~538 oil | $O_3$ | 3539.02 | 2307.04 | 1231.98 | 0.00 | 3561.30 |
| 220~350 oil | $O_2$ | 4568.02 | 4058.35 | 509.67 | 0.00 | 4548.40 |
| $C_4$~220 oil | $O_1$ | 1743.99 | 1670.25 | 73.74 | 8.60 | 1791.60 |
| $C_1$–$C_3$ hydrocarbon | OG | 1793.88 | 1779.36 | 14.53 | 58.60 | 1792.80 |
| $CO + CO_2$ | $IOG_1$ | 1303.26 | 1295.68 | 7.58 | 42.60 | 1276.60 |
| $H_2O$ | $IOG_2$ | 959.97 | 959.16 | 0.81 | 0.00 | 878.40 |
| $H_2S + NH_3$ | $IOG_3$ | 124.10 | 122.89 | 1.21 | 3.70 | 122.50 |
| nitrogen | | 67.10 | 66.80 | 0.30 | 3.70 | 67.10 |
| hydrogen | H | 678.12 | 675.56 | 2.56 | 49.90 | 643.30 |
| catalyst + ash | | 243.90 | 0.00 | 243.90 | 0.00 | 243.90 |
| total amount of reactants | M | 16045.50 | 12935.09 | 3110.41 | 167.10 | 16045.70 |
| volume flow rate of reactants | V (L/hr) | 218278.54 | 214279.00 | 3999.54 | 4719.53 | 0.00 |
| (kmol/hr) | | | | | | |
| coal flow rate | C | — | — | — | — | |
| PAAO | P | — | — | — | — | |
| 350~538 oil | $O_3$ | 14.14 | 9.22 | 4.92 | 0.00 | |
| 220~350 oil | $O_2$ | 23.95 | 21.28 | 2.67 | 0.00 | |
| $C_4$~220 oil | $O_1$ | 18.76 | 18.15 | 0.61 | 0.15 | |
| $C_1$–$C_3$ hydrocarbon | OG | 74.54 | 73.98 | 0.55 | 2.52 | |
| $CO + CO_2$ | $IOG_1$ | 36.00 | 35.80 | 0.20 | 1.13 | |
| $H_2O$ | $IOG_2$ | 53.29 | 53.24 | 0.04 | 0.00 | |
| $H_2S + NH_3$ | $IOG_3$ | 4.48 | 4.43 | 0.04 | 0.11 | |
| nitrogen | | 2.40 | 2.38 | 0.01 | 0.13 | |
| hydrogen | H | 336.39 | 335.12 | 1.27 | 24.75 | |
| catalyst + ash | | — | — | — | — | |
| total amount of reactants | M | 563.94 | 553.62 | 10.33 | 28.79 | |
| Enthalpy | kcal/hr | −3576200 | | | −128270 | |

TABLE 14-continued estimated value and actually measured value at outlet of third tower (Adaro coal)

| | | outlet of third tower | | | | |
|---|---|---|---|---|---|---|
| | | estimated value | | | | measured value |
| | | total effluent | Vapor flow rate | Slurry flow rate | cooling gas | total effluent |
| Enthalpy (coal + PAA) | kcal/hr | −59153 | | | 0 | |
| Total Enthalpy | kcal/hr | −3635353 | | | −128270 | |

Figure 9:
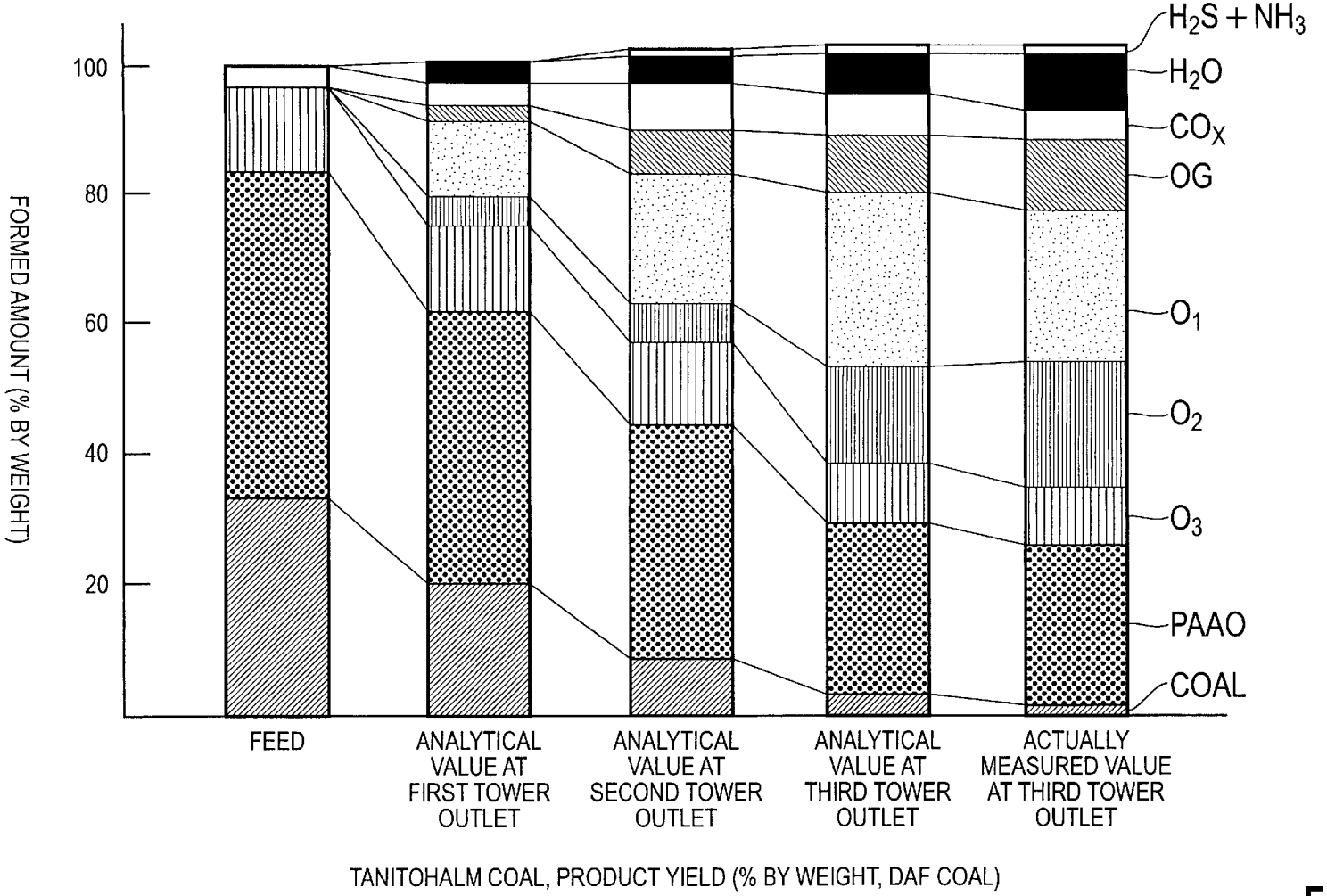
FIG. 9 is a graph showing the relationship between the product yield analyzed by using the reaction rate constant obtained by the relationship specified in the present invention and the actually measured product yield in respect of Tanitohalm coal.

Table 15 shows the size of the reaction tower used for liquefying Tanitohalm coal, the analyzed reaction time, the enthalpy difference, heat dissipation amount, etc. Tables 16 to 19 show the estimated value for each component at the inlet of the first tower, the estimated value for each component at the outlet of the first tower, the estimated value for each component at the outlet of the second tower, and the estimated value and actually measured value for each component at the outlet of the third tower, in respect of Tanitohalm coal. Further, FIG. 9 shows the analytical values of the formed products at each of the three towers and the actually measured value of the formed product at the outlet of the third tower.

TABLE 15

Tanitohalm coal

| | first tower | second tower | third tower | | |
|---|---|---|---|---|---|
| reaction tower L/D | 12.700 | 12.700 | 12.700 | | |
| reaction tower inner diameter D (cm) | 100.000 | 100.000 | 100.000 | | |
| reaction tower effective length L (cm) | 1270.000 | 1270.000 | 1270.000 | | |
| reactor inner volume (L) | 9975.000 | 9975.000 | 9975.000 | | |
| gas space velocity (cm/s) | 5.715 | 6.575 | 6.804 | | |
| liquid space velocity (cm/s) | 0.483 | 0.400 | 0.356 | | |
| mixing diffusion coefficient ($cm^2/s$) | 2873.948 | 2997.261 | 3028.222 | | |
| Peclet number | 0.214 | 0.170 | 0.149 | | |
| gas hold-up Eg | 0.466 | 0.525 | 0.540 | | |
| reaction time (s) | 1206.611 | 1507.307 | 1641.519 | sum of reaction time (s) | 4355 |
| enthalpy difference (kcal/hr) | 446983 | −22200 | −329410 | sum of enthalpy difference (kcal/hr) | 95373 |
| heat dissipation amount (kcal/hr) | 61885 | 59878 | 57502 | sum of heat dissipation amount (kcal/hr) | 179264 |

TABLE 16 estimated value at inlet of first tower (Tanitohalm coal)

| | | estimated value at inlet of first tower | | |
|---|---|---|---|---|
| | | total influent | Vapor flow rate | Slurry flow rate |
| temperature ° C. | | 403.40 | 403.40 | 403.40 |
| pressure $Kg/cm^2$ A | | 172.23 | 172.23 | 172.23 |
| (kg/hr) | | | | |
| coal flow rate ($C_A + C_B + C_I$) | | 2113.60 | — | 2113.60 |
| PAAO | P | 2924.10 | — | 2924.10 |
| 350~538 oil | $O_3$ | 4574.70 | 287.25 | 4287.45 |
| 220~350 oil | $O_2$ | 5319.20 | 1995.55 | 3323.64 |
| $C_4$~220 oil | $O_1$ | 289.00 | 199.08 | 89.92 |
| $C_1$–$C_3$ hydrocarbon | OG | 911.10 | 870.09 | 41.01 |
| $CO + CO_2$ | $IOG_1$ | 708.60 | 686.92 | 21.68 |
| $H_2O$ | $IOG_2$ | 256.30 | 254.11 | 2.19 |
| $H_2S + NH_3$ | $IOG_3$ | 49.40 | 46.58 | 2.82 |
| nitrogen | | 6.60 | 6.45 | 0.15 |
| hydrogen | H | 677.20 | 665.13 | 12.07 |
| catalyst + ash | | 445.60 | 0.00 | 445.60 |
| total amount of reactants | M | 18275.40 | 5011.17 | 13264.22 |
| volume flow rate of reactants | V (L/hr) | 164676.29 | 148786.50 | 15889.79 |
| (kmol/hr) | | | | |
| coal flow rate | C | — | — | — |
| PAAO | P | — | — | — |
| 350~538 oil | $O_3$ | 17.37 | 1.09 | 16.28 |
| 220~350 oil | $O_2$ | 28.16 | 10.56 | 17.60 |
| $C_4$~220 oil | $O_1$ | 2.98 | 2.27 | 0.71 |
| $C_1$–$C_3$ hydrocarbon | OG | 40.03 | 38.42 | 1.61 |

TABLE 16-continued estimated value at inlet of first tower (Tanitohalm coal)

| | | estimated value at inlet of first tower | | |
|---|---|---|---|---|
| | | total influent | Vapor flow rate | Slurry flow rate |
| $CO + CO_2$ | $IOG_1$ | 19.83 | 19.26 | 0.57 |
| $H_2O$ | $IOG_2$ | 14.23 | 14.11 | 0.12 |
| $H_2S + NH_3$ | $IOG_3$ | 1.45 | 1.37 | 0.08 |
| nitrogen | | 0.24 | 0.23 | 0.01 |
| hydrogen | H | 335.93 | 329.95 | 5.99 |
| catalyst + ash | | — | — | — |
| total amount of reactants | M | 460.22 | 417.25 | 42.97 |
| Enthalpy | kcal/hr | −183550 | | |
| Enthalpy (coal + PAA) | kcal/hr | −1572500 | | |
| Total Enthalpy | kcal/hr | −1756050 | | |

TABLE 17 estimated value at outlet of first tower (Tanitohalm coal)

| | | estimated value at outlet of first tower | | | |
|---|---|---|---|---|---|
| | | total influent | Vapor flow rate | Slurry flow rate | cooling gas |
| temperature ° C. | | 443.00 | 443.00 | 443.00 | 50.00 |
| pressure $Kg/cm^2$ A | | 171.73 | 171.73 | 171.73 | 174.00 |
| (kg/hr) | | | | | |
| coal flow rate ($C_A + C_B + C_I$) | | 1033.49 | — | 1033.49 | 0.00 |
| PAAO | P | 2700.54 | — | 2700.54 | 0.00 |
| 350~538 oil | $O_3$ | 4529.40 | 855.45 | 3673.95 | 0.00 |
| 220~350 oil | $O_2$ | 5654.18 | 3280.67 | 2373.52 | 0.00 |
| $C_4$~220 oil | $O_1$ | 939.74 | 733.61 | 206.13 | 5.40 |
| $C_1$–$C_3$ hydrocarbon | OG | 1132.44 | 1090.42 | 42.02 | 45.70 |
| $CO + CO_2$ | $IOG_1$ | 813.18 | 791.71 | 21.47 | 21.20 |
| $H_2O$ | $IOG_2$ | 436.67 | 434.68 | 1.99 | 0.00 |
| $H_2S + NH_3$ | $IOG_3$ | 78.97 | 75.39 | 3.57 | 2.50 |
| nitrogen | | 7.20 | 7.05 | 0.15 | 0.60 |
| hydrogen | H | 617.38 | 606.85 | 10.53 | 38.00 |
| catalyst + ash | | 445.60 | 0.00 | 445.60 | 0.00 |
| total amount of reactants | M | 18388.80 | 7875.83 | 10512.97 | 113.40 |
| volume flow rate of reactants | V (L/hr) | 175265.70 | 161600.50 | 13665.20 | 3739.32 |
| (kmol/hr) | | | | | |
| coal flow rate | C | — | — | — | — |
| PAAO | P | — | — | — | — |
| 350~538 oil | $O_3$ | 17.20 | 3.25 | 13.95 | 0.00 |
| 220~350 oil | $O_2$ | 29.93 | 17.37 | 12.57 | 0.00 |
| C4~220 oil | $O_1$ | 8.84 | 7.25 | 1.59 | 0.09 |
| $C_1$–$C_3$ hydrocarbon | OG | 48.96 | 47.31 | 1.66 | 2.01 |
| $CO + CO_2$ | $IOG_1$ | 22.84 | 22.27 | 0.58 | 0.58 |
| $H_2O$ | $IOG_2$ | 24.24 | 24.13 | 0.11 | 0.00 |
| $H_2S + NH_3$ | $IOG_3$ | 2.71 | 2.59 | 0.12 | 0.07 |
| nitrogen | | 0.26 | 0.25 | 0.01 | 0.02 |
| hydrogen | H | 306.26 | 301.04 | 5.23 | 18.85 |
| catalyst + ash | | — | — | — | — |
| total amount of reactants | M | 461.25 | 425.45 | 35.81 | 21.62 |
| Enthalpy | kcal/hr | −645590 | | | −74423 |
| Enthalpy (coal + PAA) | kcal/hr | −737900 | | | 0 |
| Total Enthalpy | kcal/hr | −1383490 | | | −74423 |

TABLE 18 estimated value at outlet of second tower (Tanitohalm coal)

| | estimated value at outlet of second tower | | | |
|---|---|---|---|---|
| | total influent | Vapor flow rate | Slurry flow rate | cooling gas |
| temperature ° C. | 454.30 | 454.30 | 454.30 | 50.00 |
| pressure $Kg/cm^2$ A | 171.33 | 171.30 | 171.33 | 174.00 |

TABLE 18-continued estimated value at outlet of second tower (Tanitohalm coal)

| | | estimated value at outlet of second tower | | | |
|---|---|---|---|---|---|
| | | total influent | Vapor flow rate | Slurry flow rate | cooling gas |
| (kg/hr) | | | | | |
| coal flow rate ($C_A + C_B + C_I$) | | 484.81 | — | 484.81 | 0.00 |
| PAAO | P | 2153.24 | — | 2153.24 | 0.00 |
| 350~538 oil | $O_3$ | 4474.47 | 1384.87 | 3089.61 | 0.00 |
| 220~350 oil | $O_2$ | 5959.24 | 4171.20 | 1788.03 | 0.00 |
| $C_4$~220 oil | $O_1$ | 1514.94 | 1282.49 | 232.45 | 18.00 |
| $C_1$–$C_3$ hydrocarbon | OG | 1438.59 | 1399.23 | 39.36 | 154.50 |
| $CO + CO_2$ | $IOG_1$ | 927.14 | 908.82 | 18.33 | 71.60 |
| $H_2O$ | $IOG_2$ | 592.40 | 590.69 | 1.72 | 0.00 |
| $H_2S + NH_3$ | $IOG_3$ | 110.84 | 107.18 | 3.65 | 8.50 |
| nitrogen | | 9.20 | 9.06 | 0.14 | 2.00 |
| hydrogen | H | 650.73 | 642.18 | 8.55 | 117.80 |
| catalyst + ash | | 445.60 | 0.00 | 445.60 | 0.00 |
| total amount of reactants | M | 18761.20 | 10495.71 | 8265.49 | 372.40 |
| volume flow rate of reactants | V (L/hr) | 197207.24 | 185892.50 | 11314.74 | 11720.70 |
| (kmol/hr) | | | | | |
| coal flow rate | C | — | — | — | — |
| PAAO | P | — | — | — | — |
| 350~538 oil | $O_3$ | 16.99 | 5.26 | 11.73 | 0.00 |
| 220~350 oil | $O_2$ | 31.55 | 22.08 | 9.47 | 0.00 |
| $C_4$~220 oil | $O_1$ | 14.13 | 12.34 | 1.79 | 0.31 |
| $C_1$–$C_3$ hydrocarbon | OG | 61.74 | 60.19 | 1.55 | 6.80 |
| $CO + CO_2$ | $IOG_1$ | 26.02 | 25.53 | 0.49 | 1.94 |
| $H_2O$ | $IOG_2$ | 32.88 | 32.79 | 0.10 | 0.00 |
| $H_2S + NH_3$ | $IOG_3$ | 3.99 | 3.86 | 0.13 | 0.25 |
| nitrogen | | 0.33 | 0.32 | 0.01 | 0.07 |
| hydrogen | H | 322.80 | 318.56 | 4.24 | 58.44 |
| catalyst + ash | | — | — | — | — |
| total amount of reactants | M | 510.44 | 480.93 | 29.51 | 67.80 |
| Enthalpy | kcal/hr | −1300200 | | | −252630 |
| Enthalpy (coal + PAA) | kcal/hr | −358120 | | | 0 |
| Total Enthalpy | kcal/hr | −1658320 | | | −252630 |

TABLE 19 estimated value and actually measured value at outlet of third tower (Tanitohalm coal)

| | | outlet of third tower | | | | |
|---|---|---|---|---|---|---|
| | | estimated value | | | | measured value |
| | | total influent | Vapor flow rate | Slurry flow rate | cooling gas | total influent |
| temperature ° C. | | 454.10 | 454.10 | 454.10 | 50.00 | |
| pressure Kg/cm$^2$ A | | 170.93 | 170.93 | 170.93 | 174.00 | |
| (kg/hr) | | | | | | |
| coal flow rate ($C_A + C_B + C_I$) | | 217.16 | — | 217.16 | 0.00 | 53.40 |
| PAAO | P | 1565.83 | — | 1565.83 | 0.00 | 1536.10 |
| 350~538 oil | $O_3$ | 4372.75 | 1584.49 | 2788.26 | 0.00 | 4340.70 |
| 220~350 oil | $O_2$ | 6259.04 | 4622.69 | 1636.35 | 0.00 | 6523.50 |
| $C_4$~220 oil | $O_1$ | 1963.81 | 1700.41 | 263.39 | 7.60 | 1694.30 |
| $C_1$–$C_3$ hydrocarbon | OG | 1624.49 | 1584.66 | 39.82 | 65.80 | 1816.40 |
| $CO + CO_2$ | $IOG_1$ | 978.30 | 960.89 | 17.42 | 30.50 | 824.20 |
| $H_2O$ | $IOG_2$ | 715.73 | 713.90 | 1.83 | 0.00 | 882.80 |
| $H_2S + NH_3$ | $IOG_3$ | 132.94 | 129.03 | 3.91 | 3.60 | 161.10 |
| nitrogen | | 10.10 | 9.96 | 0.14 | 0.90 | 15.00 |
| hydrogen | H | 635.65 | 628.05 | 7.59 | 51.80 | 618.60 |
| catalyst + ash | | 445.60 | 0.00 | 445.60 | 0.00 | 445.60 |
| total amount of reactants | M | 18921.40 | 11934.08 | 6987.32 | 160.20 | 18911.70 |
| volume flow rate of reactants | V (L/hr) | 202423.18 | 192370.60 | 10052.58 | 5132.50 | 0.00 |
| (kmol/hr) | | | | | | |
| coal flow rate | C | — | — | — | — | |
| PAAO | P | — | — | — | — | |
| 350~538 oil | $O_3$ | 16.61 | 6.02 | 10.59 | 0.00 | |
| 220~350 oil | $O_2$ | 33.14 | 24.47 | 8.66 | 0.00 | |
| $C_4$~220 oil | $O_1$ | 18.20 | 16.17 | 2.03 | 0.13 | |

TABLE 19-continued estimated value and actually measured value at outlet of third tower (Tanitohalm coal)

| | | outlet of third tower | | | | |
|---|---|---|---|---|---|---|
| | | estimated value | | | | measured value |
| | | total influent | Vapor flow rate | Slurry flow rate | cooling gas | total influent |
| $C_1$–$C_3$ hydrocarbon | OG | 69.37 | 67.80 | 1.56 | 2.89 | |
| $CO + CO_2$ | $IOG_1$ | 27.45 | 26.99 | 0.47 | 0.83 | |
| $H_2O$ | $IOG_2$ | 39.73 | 39.63 | 0.10 | 0.00 | |
| $H_2S + NH_3$ | $IOG_3$ | 4.91 | 4.77 | 0.14 | 0.11 | |
| nitrogen | | 0.36 | 0.36 | 0.01 | 0.03 | |
| hydrogen | H | 315.32 | 311.55 | 3.77 | 25.70 | |
| catalyst + ash | | — | — | — | — | |
| total amount of reactants | M | 525.09 | 497.76 | 27.33 | 29.69 | |
| Enthalpy | kcal/hr | −1907300 | | | −107310 | |
| Enthalpy (coal + PAA) | kcal/hr | −187740 | | | 0 | |
| Total Enthalpy | kcal/hr | −2095040 | | | −107310 | |

Figure 10:
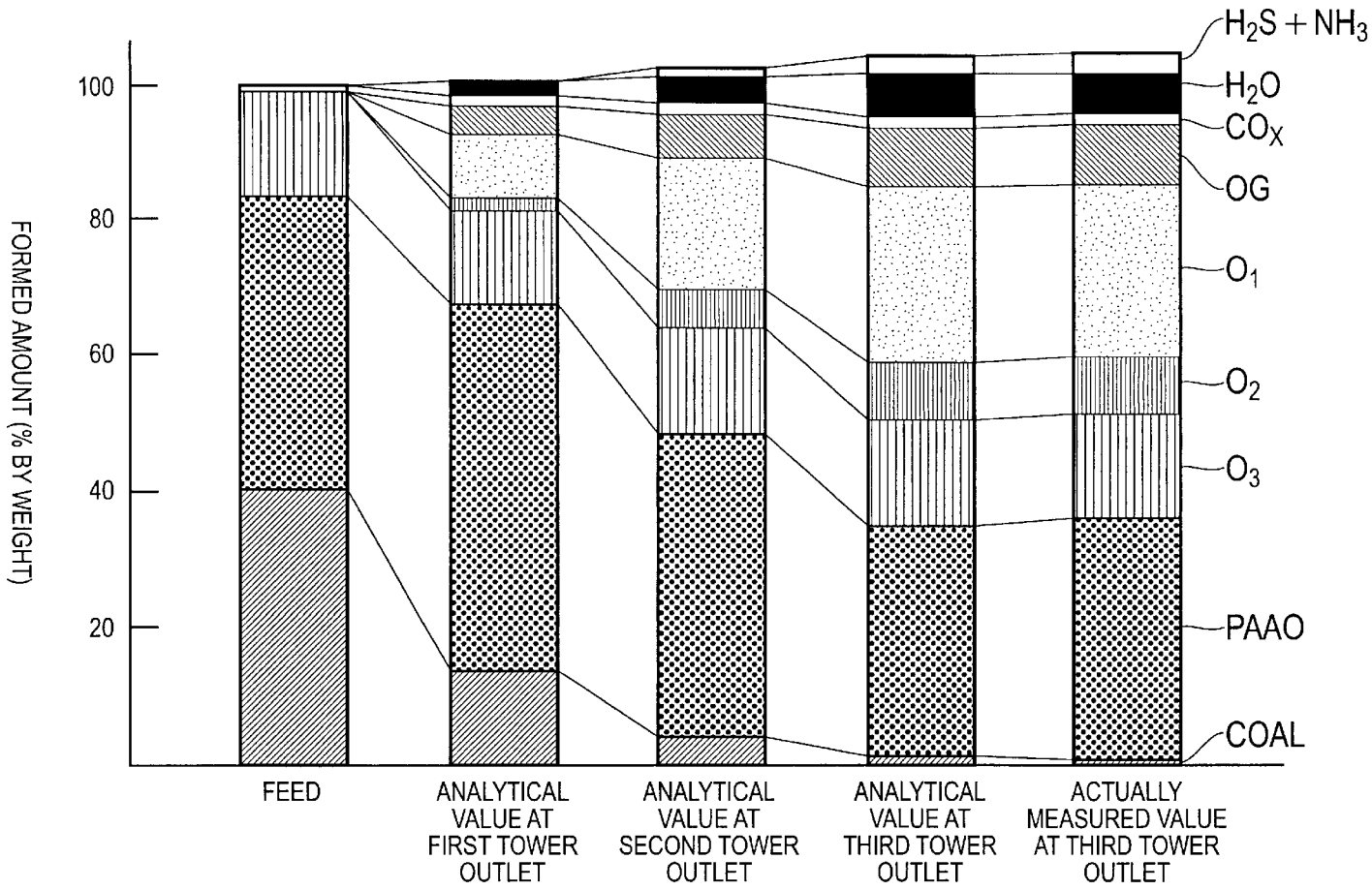
FIG. 10 is a graph showing the relationship between the product yield analyzed by using the reaction rate constant obtained by the relationship specified in the present invention and the actually measured product yield in respect of Ikeshima coal.

Table 20 shows the size of the reaction tower used for liquefying Ikeshima coal, the analyzed reaction time, the enthalpy difference, heat dissipation amount, etc. Tables 21 to 24 show the estimated value for each component at the inlet of the first tower, the estimated value for each component at the outlet of the first tower, the estimated value for each component at the outlet of the second tower, and the estimated value and actually measured value for each component at the outlet of the third tower, in respect of Ikeshima coal. Further, FIG. 10 shows the analytical values of the formed products at each of the three towers and the actually measured value of the formed product at the outlet of the third tower.

TABLE 20

Ikeshima coal

| | first tower | second tower | third tower | | |
|---|---|---|---|---|---|
| reaction tower L/D | 11.300 | 11.300 | 11.300 | | |
| reaction tower inner diameter D (cm) | 100.000 | 100.000 | 100.000 | | |
| reaction tower effective length L (cm) | 1130.000 | 1130.000 | 1130.000 | | |
| reactor inner volume (L) | 8875.000 | 8875.000 | 8875.000 | | |
| gas space velocity (cm/s) | 5.298 | 5.501 | 5.365 | | |
| liquid space velocity (cm/s) | 0.365 | 0.319 | 0.299 | | |
| mixing diffusion coefficient ($cm^2/s$) | 2809.287 | 2841.240 | 2819.978 | | |
| Peclet number | 0.147 | 0.127 | 0.120 | | |
| gas hold-up Eg | 0.450 | 0.466 | 0.458 | | |
| reaction time (s) | 1703.026 | 1890.594 | 2044.300 | sum of reaction time (s) | 5638 |
| enthalpy difference (kcal/hr) | −241892 | −365095 | −442254 | sum of enthalpy difference (kcal/hr) | −1049240 |
| heat dissipation amount (kcal/hr) | 62219 | 59549 | 57122 | sum of heat dissipation amount (kcal/hr) | 178890 |

TABLE 21 estimated value at inlet of first tower (Ikeshima coal)

| | | estimated value at inlet of first tower | | |
|---|---|---|---|---|
| | | total influent | Vapor flow rate | Slurry flow rate |
| temperature ° C. | | 420.60 | 420.60 | 420.60 |
| pressure $Kg/cm^2$ A | | 172.33 | 172.33 | 172.33 |
| (kg/hr) | | | | |
| coal flow rate ($C_A + C_B + C_I$) | | 1787.30 | — | 1787.30 |
| PAAO | P | 2114.50 | — | 2114.50 |
| 350~538 oil | $O_3$ | 3292.60 | 410.61 | 2881.99 |
| 220~350 oil | $O_2$ | 4708.00 | 2244.63 | 2463.37 |
| $C_4$~220 oil | $O_1$ | 182.80 | 150.92 | 31.88 |
| $C_1$–$C_3$ hydrocarbon | OG | 988.00 | 953.94 | 34.06 |
| $CO + CO_2$ | $IOG_1$ | 165.50 | 161.58 | 3.92 |
| $H_2O$ | $IOG_2$ | 61.40 | 61.06 | 0.34 |
| $H_2S + NH_3$ | $IOG_3$ | 111.60 | 106.70 | 4.90 |
| nitrogen | | 52.00 | 51.07 | 0.93 |
| hydrogen | H | 673.30 | 663.51 | 9.79 |
| catalyst + ash | | 616.60 | 0.00 | 616.60 |

TABLE 21-continued estimated value at inlet of first tower (Ikeshima coal)

| | | estimated value at inlet of first tower | | |
|---|---|---|---|---|
| | | total influent | Vapor flow rate | Slurry flow rate |
| total amount of reactants | M | 14753.60 | 4804.02 | 9949.58 |
| volume flow rate of reactants | V (L/hr) | 158448.71 | 146731.00 | 11717.71 |
| (kmol/hr) | | | | |
| coal flow rate | C | — | — | — |
| PAAO | P | — | — | — |
| 350~538 oil | $O_3$ | 12.94 | 1.61 | 11.32 |
| 220~350 oil | $O_2$ | 24.45 | 11.66 | 12.79 |
| C4~220 oil | $O_1$ | 2.35 | 2.06 | 0.29 |
| $C_1$–$C_3$ hydrocarbon | OG | 44.54 | 43.16 | 1.38 |
| $CO + CO_2$ | $IOG_1$ | 4.73 | 4.62 | 0.11 |
| $H_2O$ | $IOG_2$ | 3.41 | 3.39 | 0.02 |
| $H_2S + NH_3$ | $IOG_3$ | 3.27 | 3.13 | 0.14 |
| nitrogen | | 1.86 | 1.82 | 0.03 |
| hydrogen | H | 334.00 | 329.14 | 4.86 |
| catalyst + ash | | — | — | — |
| total amount of reactants | M | 431.55 | 400.60 | 30.94 |
| Enthalpy | kcal/hr | 1075800 | | |
| Enthalpy (coal + PAA) | kcal/hr | −172490 | | |
| Total Enthalpy | kcal/hr | 903310 | | |

TABLE 22 estimated value at outlet of first tower (Ikeshima coal)

| | | estimated value at outlet of first tower | | | |
|---|---|---|---|---|---|
| | | total influent | Vapor flow rate | Slurry flow rate | cooling gas |
| temperature ° C. | | 445.10 | 445.10 | 445.10 | 29.40 |
| pressure $Kg/cm^2$ A | | 171.93 | 171.93 | 171.93 | 174.00 |
| (kg/hr) | | | | | |
| coal flow rate ($C_A + C_B + C_I$) | | 566.88 | — | 566.88 | 0.00 |
| PAAO | P | 2534.10 | — | 2534.10 | 0.00 |
| 350~538 oil | $O_3$ | 3326.72 | 790.95 | 2535.77 | 0.00 |
| 220~350 oil | $O_2$ | 4792.73 | 2938.45 | 1854.28 | 0.00 |
| $C_4$~220 oil | $O_1$ | 597.68 | 497.19 | 100.49 | 0.00 |
| $C_1$–$C_3$ hydrocarbon | OG | 1160.23 | 1125.07 | 35.17 | 0.40 |
| $CO + CO_2$ | $IOG_1$ | 181.73 | 177.84 | 3.88 | 0.00 |
| $H_2O$ | $IOG_2$ | 169.51 | 168.89 | 0.62 | 0.00 |
| $H_2S + NH_3$ | $IOG_3$ | 152.12 | 146.44 | 5.68 | 0.00 |
| nitrogen | | 52.00 | 51.13 | 0.87 | 0.00 |
| hydrogen | H | 608.49 | 599.98 | 8.51 | 4.80 |
| catalyst + ash | | 616.60 | 0.00 | 616.60 | 0.00 |
| total amount of reactants | M | 14758.80 | 6495.94 | 8262.86 | 5.20 |
| volume flow rate of reactants | V (L/hr) | 160105.70 | 149796.00 | 10309.70 | 389.81 |
| (kmol/hr) | | | | | |
| coal flow rate | C | — | — | — | — |
| PAAO | P | — | — | — | — |
| 350~538 oil | $O_3$ | 13.07 | 3.11 | 9.96 | 0.00 |
| 220~350 oil | $O_2$ | 24.89 | 15.26 | 9.63 | 0.00 |
| C4~220 oil | $O_1$ | 6.42 | 5.61 | 0.81 | 0.00 |
| $C_1$–$C_3$ hydrocarbon | OG | 51.33 | 49.92 | 1.42 | 0.02 |
| $CO + CO_2$ | $IOG_1$ | 5.20 | 5.10 | 0.11 | 0.00 |
| $H_2O$ | $IOG_2$ | 9.41 | 9.37 | 0.03 | 0.00 |
| $H_2S + NH_3$ | $IOG_3$ | 5.06 | 4.87 | 0.19 | 0.00 |
| nitrogen | | 1.86 | 1.83 | 0.03 | 0.00 |
| hydrogen | H | 301.85 | 297.63 | 4.22 | 2.38 |
| catalyst + ash | | — | — | — | — |
| total amount of reactants | M | 419.09 | 392.69 | 26.40 | 2.40 |
| Enthalpy | kcal/hr | 758253 | | | −160 |
| Enthalpy (coal + PAA) | kcal/hr | −96995 | | | 0 |
| Total Enthalpy | kcal/hr | 661258 | | | −160 |

TABLE 23 estimated value at outlet of second tower (Ikeshima coal)

| | | estimated value at outlet of second tower | | | |
|---|---|---|---|---|---|
| | | total influent | Vapor flow rate | Slurry flow rate | cooling gas |
| temperature ° C. | | 452.10 | 452.10 | 452.10 | 29.40 |
| pressure Kg/cm$^2$ A | | 171.53 | 171.53 | 171.53 | 174.00 |
| (kg/hr) | | | | | |
| coal flow rate ($C_A + C_B + C_I$) | | 167.22 | — | 167.22 | 0.00 |
| PAAO | P | 2179.37 | — | 2179.37 | 0.00 |
| 350~538 oil | $O_3$ | 3355.76 | 1079.34 | 2276.42 | 0.00 |
| 220~350 oil | $O_2$ | 4877.17 | 3349.23 | 1527.95 | 0.00 |
| $C_4$~220 oil | $O_1$ | 1000.19 | 859.69 | 140.50 | 6.40 |
| $C_1$–$C_3$ hydrocarbon | OG | 1375.99 | 1339.71 | 36.28 | 51.70 |
| $CO + CO_2$ | $IOG_1$ | 193.24 | 189.61 | 3.63 | 6.20 |
| $H_2O$ | $IOG_2$ | 272.72 | 271.94 | 0.78 | 0.00 |
| $H_2S + NH_3$ | $IOG_3$ | 196.71 | 190.41 | 6.30 | 5.90 |
| nitrogen | | 54.80 | 53.98 | 0.82 | 2.80 |
| hydrogen | H | 579.93 | 572.63 | 7.30 | 37.90 |
| catalyst + ash | | 616.60 | 0.00 | 616.60 | 0.00 |
| total amount of reactants | M | 14869.70 | 7906.53 | 6963.17 | 110.90 |
| volume flow rate of reactants | V (L/hr) | 164576.07 | 155551.00 | 9025.07 | 3519.60 |
| (kmol/hr) | | | | | |
| coal flow rate | C | — | — | — | — |
| PAAO | P | — | — | — | — |
| 350~538 oil | $O_3$ | 13.19 | 4.24 | 8.94 | 0.00 |
| 220~350 oil | $O_2$ | 25.33 | 17.39 | 7.93 | 0.00 |
| C4~220 oil | $O_1$ | 10.42 | 9.30 | 1.13 | 0.11 |
| $C_1$–$C_3$ hydrocarbon | OG | 60.13 | 58.68 | 1.45 | 2.33 |
| $CO + CO_2$ | $IOG_1$ | 5.53 | 5.43 | 0.10 | 0.18 |
| $H_2O$ | $IOG_2$ | 15.14 | 15.09 | 0.04 | 0.00 |
| $H_2S + NH_3$ | $IOG_3$ | 6.94 | 6.71 | 0.22 | 0.17 |
| nitrogen | | 1.96 | 1.93 | 0.03 | 0.10 |
| hydrogen | H | 287.68 | 284.06 | 3.62 | 18.80 |
| catalyst + ash | | — | — | — | — |
| total amount of reactants | M | 426.31 | 402.84 | 23.47 | 21.69 |
| Enthalpy | kcal/hr | 313419 | | | −58210 |
| Enthalpy (coal + PAA) | kcal/hr | −75466 | | | 0 |
| Total Enthalpy | kcal/hr | 237953 | | | −58210 |

TABLE 24 estimated value and actually measured value at outlet of third tower (Ikeshima coal)

| | | outlet of third tower | | | | |
|---|---|---|---|---|---|---|
| | | estimated value | | | | measured value |
| | | total influent | Vapor flow rate | Slurry flow rate | cooling gas | total influent |
| temperature ° C. | | 451.50 | 451.50 | 451.50 | 29.40 | |
| pressure Kg/cm$^2$ A | | 171.03 | 171.03 | 171.03 | 174.00 | |
| (kg/hr) | | | | | | |
| coal flow rate ($C_A + C_B + C_I$) | | 46.65 | — | 45.65 | 0.00 | 34.50 |
| PAAO | P | 1675.59 | — | 1675.59 | 0.00 | 1751.00 |
| 350~538 oil | $O_3$ | 3362.61 | 1181.50 | 2181.11 | 0.00 | 3341.90 |
| 220~350 oil | $O_2$ | 4964.65 | 3502.46 | 1462.19 | 0.00 | 4989.20 |
| $C_4$~220 oil | $O_1$ | 1329.49 | 1148.82 | 180.67 | 0.00 | 1288.10 |
| $C_1$–$C_3$ hydrocarbon | OG | 1512.37 | 1472.37 | 40.01 | 0.00 | 1518.20 |
| $CO + CO_2$ | $IOG_1$ | 194.85 | 191.16 | 3.69 | 0.00 | 179.70 |
| $H_2O$ | $IOG_2$ | 358.53 | 357.51 | 1.02 | 0.00 | 322.70 |
| $H_2S + NH_3$ | $IOG_3$ | 228.88 | 221.57 | 7.31 | 0.00 | 217.10 |
| nitrogen | | 54.80 | 53.97 | 0.83 | 0.00 | 54.90 |
| hydrogen | H | 527.78 | 521.00 | 6.77 | 3.10 | 556.60 |
| catalyst + ash | | 616.60 | 0.00 | 616.60 | 0.00 | 616.60 |
| total amount of reactants | M | 14872.80 | 8650.36 | 6222.44 | 3.10 | 14870.50 |
| volume flow rate of reactants | V (L/hr) | 160170.31 | 151704.70 | 8465.61 | 249.75 | 0.00 |
| (kmol/hr) | | | | | | |
| coal flow rate | C | — | — | — | — | |
| PAAO | P | — | — | — | — | |
| 350~538 oil | $O_3$ | 13.21 | 4.64 | 8.57 | 0.00 | |

TABLE 24-continued estimated value and actually measured value at outlet of third tower (Ikeshima coal)

| | | outlet of third tower | | | | |
|---|---|---|---|---|---|---|
| | | estimated value | | | | measured value |
| | | total influent | Vapor flow rate | Slurry flow rate | cooling gas | total influent |
| 220~350 oil | $O_2$ | 25.78 | 18.19 | 7.59 | 0.00 | |
| C4~220 oil | $O_1$ | 13.65 | 12.21 | 1.44 | 0.00 | |
| $C_1$–$C_3$ hydrocarbon | OG | 65.51 | 63.92 | 1.59 | 0.00 | |
| $CO + CO_2$ | $IOG_1$ | 5.58 | 5.48 | 0.10 | 0.00 | |
| $H_2O$ | $IOG_2$ | 19.90 | 19.84 | 0.06 | 0.00 | |
| $H_2S + NH_3$ | $IOG_3$ | 8.35 | 8.09 | 0.27 | 0.00 | |
| nitrogen | | 1.96 | 1.93 | 0.03 | 0.00 | |
| hydrogen | H | 261.81 | 258.45 | 3.36 | 1.54 | |
| catalyst + ash | | — | — | — | — | |
| total amount of reactants | M | 415.76 | 392.75 | 23.01 | 1.54 | |
| Enthalpy | kcal/hr | −131380 | | | 122 | |
| Enthalpy (coal + PAA) | kcal/hr | −72798 | | | 0 | |
| Total Enthalpy | kcal/hr | −204178 | | | 122 | |

The experimental data support that it is possible to estimate the reaction products very close to the actually measured values by analyzing the liquefying reaction in accordance with the reaction model shown in FIG. 1 by using the reaction rate constant obtained by the relationship described previously.

APPLICABILITY IN THE INDUSTRY

As apparent from the above description, the estimating method of the present invention is adapted for the case where the effluent flow rate for each component of the coal liquefying reactor is estimated accurately and easily, is employed for calculation of the reaction rate constant on the basis of the actually measured data so as to make it possible conduct simulation of the coal liquefying reactor and, thus, is useful for making various estimates in respect of the feasibility study and the operation control.

Also, according to the present invention, the reaction rate constant is obtained by calculation using a functional formula involving coal components as variables. Therefore, where an optional coal having a different degree of coalification is liquefied, the reaction rate constant for the particular coal can be obtained easily by substituting the coal component in the functional formula, making it unnecessary to conduct a continuous demonstrating operation using a bench scale plant or a pilot plant, which was required in the past for each kind of the coal. It follows that it is possible to save markedly the expenses and time required for the development of the coal liquefying technology. The estimating method of the present invention makes it possible to study the operating conditions such as selection of the kind of the raw material coal, the reaction temperature, the reaction pressure and the reaction time, leading to the design of the optimum shape of the reactor (reaction vessel).

What is claimed is:

1. A method of estimating the effluent amount for each component of an effluent at the outlet of a reaction vessel in which a liquefying reaction is carried out by blowing a hydrogen gas into a coal slurry, comprising the steps of:

calculating the reaction vessel residence time within the reaction vessel for each of a gaseous phase and a liquid phase resulting from said liquefying reaction by assuming the effluent amount for each component of the effluent;

calculating the effluent amount for each component of the effluent on the basis of the reaction vessel residence time, the inflow amount for each component of the influent into the reactor, and a primary irreversible reaction rate formula derived from a coal liquefying reaction model; and repeating the calculations until the assumed effluent amount for each component coincides, within a range of error, with the effluent amount for each component obtained by calculation so as to determine the estimated value of the effluent amount for each component.

2. The method according to claim 1, wherein:

the primary irreversible reaction rate formula is derived from a reaction model in which coal excluding water and ash is classified into three components consisting of a component having a high liquefying reactivity, a component having a low liquefying reactivity and a component highly unlikely to be liquefied; liquefied oil and solid liquefied product are classified into four components consisting of a liquefied oil component having a low boiling point, a liquefied oil component having an intermediate boiling point, a liquefied oil component having a high boiling point, and asphaltenes containing liquefied oil; and other liquefied product is classified into four components consisting of a lower hydrocarbon gas, carbon monoxide and carbon dioxide gases, water, and hydrogen sulfide and ammonia gases; and the coal is decomposed by reaction among 12 components consisting of the three components of the coal, the four components of the liquefied oil and the solid liquefied products, the four components of the other liquefied product, and hydrogen into a liquefied product along the reaction route in which a consecutive reaction and a parallel reaction of a primary reversible reaction are combined, and the liquefied product is further decomposed partly into another liquefied product having a smaller molecular weight.

3. The method according to claim 2, wherein, when the liquefied oil or the solid liquefied product is classified into four components consisting of a liquefied oil component having a low boiling point, a liquefied oil component having an intermediate boiling point, a liquefied oil component having a high boiling point, and asphaltenes containing the liquefied oil, and when the other liquefied product is classified into four components consisting of a group of a lower hydrocarbon gas, a group consisting of carbon monoxide and carbon dioxide gases, a group consisting of water alone, and another group consisting of hydrogen sulfide and ammonia gases, the hydrocarbon compound group having 1 to 3 carbon atoms is classified as a lower hydrocarbon gas, a liquefied oil having a boiling point not higher than 220° C. under atmospheric pressure and excluding the lower hydrocarbon gas is classified as a liquefied oil component having a low boiling point, a liquefied oil having a boiling point not lower than 220° C. and lower than 350° C. under atmospheric pressure is classified as a liquefied oil component having an intermediate boiling point, a liquefied oil having a boiling point not lower than 350° C. and lower than 538° C. under atmospheric pressure is classified as a liquefied oil component having a high boiling point, and a liquefied oil having a boiling point not lower than 538° C. under atmospheric pressure and a solid component soluble in tetrahydrofuran are classified as asphaltenes.

4. The method according to claim 2, wherein, when the coal excluding the ash component is classified into three components consisting of a component having a high liquefying reactivity, a component having a low liquefying reactivity, and a component highly unlikely to be liquefied, the component of the coal having at least 0.5/min of a primary irreversible reaction rate constant of the conversion reaction from the coal into a liquefied product at 450° C. is classified as the component having a high liquefying reactivity, the component of the coal having the primary irreversible reaction constant smaller than 0.5/min and not smaller than $10^{-4}$/min is classified as the component having a low liquefying reactivity, and the component of the coal having the primary irreversible reaction constant smaller than $10^{-4}$/min is classified as the component highly unlikely to be liquefied.

5. A method of estimating the effluent amount for each component of the effluent of a coal liquefying reaction vessel, comprising the steps of:

assuming the effluent amount for each component of the effluent so as to calculate a gas-liquid equilibrium composition within the reaction vessel of a mixture of the composition;

further calculating the volume flow rates of a gaseous phase and a liquid phase within the reaction vessel;

calculating the residence time of the gaseous phase and the liquid phase within the reaction vessel on the basis of the gas hold up within the reaction vessel calculated from the volume flow rate and the empirical formula;

calculating the effluent amount for each component of the effluent on the basis of a primary irreversible reaction rate formula derived from the residence time within the reaction vessel, the inflow amount for each component of the influent into the reactor, and a coal liquefying reaction model;

comparing the effluent amount for each component assumed first with the effluent amount for each component obtained by calculation; and repeating the series of calculations until the two effluent amounts for each component are allowed to coincide with each other for each component within a range of error.

6. The method according to claim 2, wherein:

the primary irreversible reaction rate formula is derived from a reaction model in which coal excluding water and ash is classified into three components consisting of a component having a high liquefying reactivity, a component having a low liquefying reactivity and a component highly unlikely to be liquefied; liquefied oil and solid liquefied product are classified into four components consisting of a liquefied oil component having a low boiling point, a liquefied oil component having an intermediate boiling point, a liquefied oil component having a high boiling point, and asphaltenes containing liquefied oil; and other liquefied product is classified into four components consisting of a lower hydrocarbon gas, carbon monoxide and carbon dioxide gases, water, and hydrogen sulfide and ammonia gases; and the coal is decomposed by reaction among 12 components consisting of the three components of the coal, the four components of the liquefied oil and the solid liquefied products, the four components of the other liquefied product, and hydrogen into a liquefied product along the reaction route in which a consecutive reaction and a parallel reaction of a primary reversible reaction are combined, and the liquefied product is further decomposed partly into another liquefied product having a smaller molecular weight.

7. The method according to claim 6, wherein, when the liquefied oil or the solid liquefied product is classified into four components consisting of a liquefied oil component having a low boiling point, a liquefied oil component having an intermediate boiling point, a liquefied oil component having a high boiling point, and asphaltenes containing the liquefied oil, and when the other liquefied product is classified into four components consisting of a group of a lower hydrocarbon gas, a group consisting of carbon monoxide and carbon dioxide gases, a group consisting of water alone, and another group consisting of hydrogen sulfide and ammonia gases, the hydrocarbon compound group having 1 to 3 carbon atoms is classified as a lower hydrocarbon gas, a liquefied oil having a boiling point not higher than 220° C. under atmospheric pressure and excluding the lower hydrocarbon gas is classified as a liquefied oil component having a low boiling point, a liquefied oil having a boiling point not lower than 220° C. and lower than 350° C. under atmospheric pressure is classified as a liquefied oil component having an intermediate boiling point, a liquefied oil having a boiling point not lower than 350° C. and lower than 538° C. under atmospheric pressure is classified as a liquefied oil component having a high boiling point, and a liquefied oil having a boiling point not lower than 538° C. under atmospheric pressure and a solid component soluble in tetrahydrofuran are classified as asphaltenes.

8. The method according to claim 6, wherein, when the coal excluding the ash component is classified into three components consisting of a component having a high liquefying reactivity, a component having a low liquefying reactivity, and a component highly unlikely to be liquefied, the component of the coal having at least 0.5/min of a primary irreversible reaction rate constant of the conversion reaction from the coal into a liquefied product at 450° C. is classified as the component having a high liquefying reactivity, the component of the coal having the primary irreversible reaction constant smaller than 0.5/min and not smaller than $10^{-4}$/min is classified as the component having a low liquefying reactivity, and the component of the coal having the primary irreversible reaction constant smaller than $10^{-4}$/min is classified as the component highly unlikely to be liquefied.

9. A method of estimating a reaction rate constant for a coal liquefying reaction in a vessel column reactor having an N-number of vessels on the basis of the actually measured value of the effluent amount for each component of the N-th vessel of the vessel column reactor, comprising the steps of:

assuming a reaction rate constant; successively calculating the effluent amount for each component of the effluent from each vessel until the N-th vessel by using the assumed reaction rate constant;

comparing the calculated value of the effluent amount for each component of the N-th vessel with the actually measured value; and repeating the series of calculations until these two sets of the effluent amounts for each component are allowed to coincide with each other within a range of error.

10. The method according to claim 9, wherein:

said method uses a primary irreversible reaction rate formula derived from a reaction model in which coal excluding water and ash is classified into three components consisting of a component having a high liquefying reactivity, a component having a low liquefying reactivity and a component highly unlikely to be liquefied; liquefied oil and solid liquefied product are classified into four components consisting of a liquefied oil component having a low boiling point, a liquefied oil component having an intermediate boiling point, a liquefied oil component having a high boiling point, and asphaltenes containing liquefied oil; and other liquefied product is classified into four components consisting of a lower hydrocarbon gas, carbon monoxide and carbon dioxide gases, water, and hydrogen sulfide and ammonia gases;

the coal is decomposed by reaction among 12 components consisting of the three components of the coal, the four components of the liquefied oil and the solid liquefied products, the four components of the other liquefied product, and hydrogen into a liquefied product along the reaction route in which a consecutive reaction and a parallel reaction of a primary reversible reaction are combined, and the liquefied product is further decomposed partly into another liquefied product having a smaller molecular weight.

11. The method according to claim 10, wherein, when the liquefied oil or the solid liquefied product is classified into four components consisting of a liquefied oil component having a low boiling point, a liquefied oil component having an intermediate boiling point, a liquefied oil component having a high boiling point, and asphaltenes containing the liquefied oil, and when the other liquefied product is classified into four components consisting of a group of a lower hydrocarbon gas, a group consisting of carbon monoxide and carbon dioxide gases, a group consisting of water alone, and another group consisting of hydrogen sulfide and ammonia gases, the hydrocarbon compound group having 1 to 3 carbon atoms is classified as a lower hydrocarbon gas, a liquefied oil having a boiling point not higher than 220° C. under atmospheric pressure and excluding the lower hydrocarbon gas is classified as a liquefied oil component having a low boiling point, a liquefied oil having a boiling point not lower than 220° C. and lower than 350° C. under atmospheric pressure is classified as a liquefied oil component having an intermediate boiling point, a liquefied oil having a boiling point not lower than 350° C. and lower than 538° C. under atmospheric pressure is classified as a liquefied oil component having a high boiling point, and a liquefied oil having a boiling point not lower than 538° C. under atmospheric pressure and a solid component soluble in tetrahydrofuran are classified as asphaltenes.

12. The method according to claim 10, wherein, when the coal excluding the ash component is classified into three components consisting of a component having a high liquefying reactivity, a component having a low liquefying reactivity, and a component highly unlikely to be liquefied, the component of the coal having at least 0.5/min of a primary irreversible reaction rate constant of the conversion reaction from the coal into a liquefied product at 450° C. is classified as the component having a high liquefying reactivity, the component of the coal having the primary irreversible reaction constant smaller than 0.5/min and not smaller than $10^{-4}$/min is classified as the component having a low liquefying reactivity, and the component of the coal having the primary irreversible reaction constant smaller than $10^{-4}$/min is classified as the component highly unlikely to be liquefied.

13. A method of estimating the reaction rate constant of the coal liquefying reaction in a vessel column reactor having an N-number of vessels on the basis of the actually measured value of the effluent for each component of the N-th vessel of the vessel column reactor, comprising the steps of:

assuming a reaction rate constant; successively calculating the effluent amount for each component of the effluent from each vessel until the N−1-th vessel by using the assumed reaction rate constant;

newly calculating a reaction rate constant on the basis of the effluent amount for each component of the N−1-th vessel and the effluent amount for each component of the N-th vessel;

comparing the reaction rate constant assumed first with the reaction rate constant newly obtained by calculation; and repeating the series of calculations until these two sets of reaction rate constants are allowed to coincide with each other for each reaction rate constant within a range of error.

14. The method according to claim 13, wherein:

said method uses a primary irreversible reaction rate formula derived from a reaction model in which coal excluding water and ash is classified into three components consisting of a component having a high liquefying reactivity, a component having a low liquefying reactivity and a component highly unlikely to be liquefied; liquefied oil and solid liquefied product are classified into four components consisting of a liquefied oil component having a low boiling point, a liquefied oil component having an intermediate boiling point, a liquefied oil component having a high boiling point, and asphaltenes containing liquefied oil; and other liquefied product is classified into four components consisting of a lower hydrocarbon gas, carbon monoxide and carbon dioxide gases, water, and hydrogen sulfide and ammonia gases;

the coal is decomposed by reaction among 12 components consisting of the three components of the coal, the four components of the liquefied oil and the solid liquefied products, the four components of the other liquefied product, and hydrogen into a liquefied product along the reaction route in which a consecutive reaction and a parallel reaction of a primary reversible reaction are combined, and the liquefied product is further decomposed partly into another liquefied product having a smaller molecular weight.

15. The method according to claim 14, wherein, when the liquefied oil or the solid liquefied product is classified into four components consisting of a liquefied oil component having a low boiling point, a liquefied oil component having an intermediate boiling point, a liquefied oil component having a high boiling point, and asphaltenes containing the liquefied oil, and when the other liquefied product is classified into four components consisting of a group of a lower hydrocarbon gas, a group consisting of carbon monoxide and carbon dioxide gases, a group consisting of water alone, and another group consisting of hydrogen sulfide and ammonia gases, the hydrocarbon compound group having 1 to 3 carbon atoms is classified as a lower hydrocarbon gas, a liquefied oil having a boiling point not higher than 220° C. under atmospheric pressure and excluding the lower hydrocarbon gas is classified as a liquefied oil component having a low boiling point, a liquefied oil having a boiling point not lower than 220° C. and lower than 350° C. under atmospheric pressure is classified as a liquefied oil component having an intermediate boiling point, a liquefied oil having a boiling point not lower than 350° C. and lower than 538° C. under atmospheric pressure is classified as a liquefied oil component having a high boiling point, and a liquefied oil having a boiling point not lower than 538° C. under atmospheric pressure and a solid component soluble in tetrahydrofuran are classified as asphaltenes.

16. The method according to claim 14, wherein, when the coal excluding the ash component is classified into three components consisting of a component having a high liquefying reactivity, a component having a low liquefying reactivity, and a component highly unlikely to be liquefied, the component of the coal having at least 0.5/min of a primary irreversible reaction rate constant of the conversion reaction from the coal into a liquefied product at 450° C. is classified as the component having a high liquefying reactivity, the component of the coal having the primary irreversible reaction constant smaller than 0.5/min and not smaller than $10^{-4}$/min is classified as the component having a low liquefying reactivity, and the component of the coal having the primary irreversible reaction constant smaller than $10^{-4}$/min is classified as the component highly unlikely to be liquefied.

17. A method of estimating the effluent amount for each component of an effluent at the outlet of a reaction vessel in which a hydrogen gas is blown into a coal slurry for carrying out a liquefying reaction, comprising the steps of:

assuming the effluent amount for each component of the effluent in accordance with a coal liquefying reaction model set in advance in respect of each of a plurality of kinds of coal slurries differing from each other in the degree of coalification and calculating the residence time in the reaction vessel for each of a gaseous phase and a liquid phase within the reaction vessel;

calculating the effluent amount for each component of the effluent on the basis of the residence time in the reaction vessel, the inflow amount for each component of the influent into the reaction vessel, and a primary irreversible reaction rate formula derived from the coal liquefying reaction model;

obtaining a reaction rate constant of the primary irreversible reaction rate formula, which permits the calculated effluent amount for each component and the assumed effluent amount for each component to coincide with each other within a range of error; and obtaining a formula showing the relationship between the reaction rate constant and the component of the coal on the basis of the reaction rate constant obtained for each kind of coal and each component of each kind of coal, followed by calculating the reaction rate constant of liquefying the coal on the basis of each component of the coal that has been liquefied and the formula showing the particular relationship, thereby estimating the effluent amount for each component of the effluent on the basis of the coal liquefying reaction model.

18. The method according to claim 17, wherein, where coal excluding water and ash is classified into three components consisting of a component having a high liquefying reactivity, a component having a low liquefying reactivity, and a component highly unlikely to be liquefied, where liquefied oil and solid liquefied product of the effluent is classified into four components consisting of a component having a low boiling point, a component having an intermediate boiling point, a component having a high boiling point, and asphaltenes containing a liquefied oil, and where other liquefied product of the effluent is classified into four components consisting of a group of a lower hydrocarbon gas, a group of carbon monoxide and carbon dioxide gases, a group consisting of water alone, and a group consisting of hydrogen sulfide and ammonia, the relationship between the reaction rate constant and the component of the coal can be represented as follows:

$$K32=K32_0\times10^{A32\{(H/C)\times VM\}+B32} \quad \text{[formula 35]}$$

$$K43=K43_0\times10^{A43\{(H/C)\times VM\}+B43} \quad \text{[formula 36]}$$

$$K54=K54_0\times10^{A54\{(H/C)\times VM\}+B54} \quad \text{[formula 37]}$$

$$K63=K63_0\times10^{A63\{(H/C)\times VM\}+B63} \quad \text{[formula 38]}$$

$$K73=K73_0\times10^{A73\{(H/C)\times VM-O\}+B73} \quad \text{[formula 39]}$$

$$K103=K103_0\times10^{A103\{(H/C)\times O\}+B103} \quad \text{[formula 40]}$$

$$K93=K93_0\times10^{A93\{(N+S)+B93} \quad \text{[formula 41]}$$

$$K81=K81_0\times10^{A81\{(H/C)\times O\}+B91} \quad \text{[formula 42]}$$

$$K10=K10_0\times10^{A10\{(H/C)\times VM\}+B10} \quad \text{[formula 43]}$$

where, K32 is a reaction rate constant of the reaction for producing the asphaltenes from the component of the coal having a low liquefying reactivity;

K43 is a reaction rate constant of the reaction for producing the liquefied oil component having a high boiling point from the asphaltenes;

K54 is a reaction rate constant of the reaction for producing the liquefied oil component having an intermediate boiling point from the liquefied oil component having a high boiling point;

K63 is a reaction rate constant of the reaction for producing the liquefied oil component having a low boiling point from the asphaltenes;

K73 is a reaction rate constant of the reaction for producing the lower hydrocarbon gas from the asphaltenes;

K103 is a reaction rate constant of the reaction for producing the water from the asphaltenes;

K93 is a reaction rate constant of the reaction for producing the hydrogen sulfide and ammonia from the asphaltenes;

K81 is a reaction rate constant of the reaction for producing the carbon monoxide gas and the carbon dioxide gas from the component of the coal having a high liquefying reactivity; and K10 is a reaction rate constant of the reaction between the hydrogen gas and the asphaltenes, where H/C represents the ratio of the hydrogen atom to the carbon atom contained in the dry coal;

O represents the weight ratio of oxygen contained in the dry coal;

N represent the weight ratio of nitrogen contained in the dry coal;

S represents the weight ratio of sulfur contained in the dry coal; and

VM represents the weight ratio of the volatile component contained in the dry coal, and where A32 represents the inclination of the straight line represented by formula (35), covering the case where (H/C)×VM is plotted on the abscissa and K32 is plotted on the logarithmic scale on the ordinate;

$K32_0$ represents a part of the intercept of the straight line crossing the ordinate, which denotes the value of K32 at (H/C)×VM of the kind of coal used for obtaining the relationship noted above;

B32 represents a part of the intercept of the straight line noted above, which denotes a value equal to −A32{(H/C)×VM} in the case where $K32=K32_0$;

A43 represents the inclination of the straight line represented by formula (36), covering the case where (H/C)×VM is plotted on the abscissa and K43 in a logarithmic scale is plotted on the ordinate;

$K43_0$ is a part of the intercept of the straight line crossing the ordinate, which denotes the value of K43 at (H/C)×VM of the kind of coal used for obtaining the particular relationship;

B43 represents a part of the intercept of the straight line, which denotes the value equal to −A43{(H/C)×VW} when $K43=K43_0$;

A54 represents the inclination of the straight line represented by formula (37), covering the case where (H/C)×VM is plotted on the abscissa and K54 is plotted in a logarithmic scale on the ordinate;

$K54_0$ represents a part of the intercept of the straight line crossing the ordinate, which denotes the value of K54 at (H/C)×VM of the kind of the coal used for obtaining the relationship;

B54 represents a part of the intercept of the straight line, which denotes a value equal to −A54{(H/C)×VM} when $K54=K54_0$;

A63 represents the inclination of the straight line represented by formula (38), covering the case where (H/C)×VM is plotted on the abscissa and K63 is plotted in a logarithmic scale on the ordinate;

$K63_0$ represents a part of the intercept of the straight line crossing the ordinate, which denotes the value of K63 at (H/C)×VM of the kind of the coal used for obtaining the relationship;

B63 represents a part of the intercept of the straight line, which denotes a value equal to −A63{(H/C)×VM} when $K63=K63_0$;

A73 represents the inclination of the straight line represented by formula (39), covering the case where (H/C)×VM is plotted on the abscissa and K73 is plotted in a logarithmic scale on the ordinate;

$K73_0$ represents a part of the intercept of the straight line crossing the ordinate, which denotes the value of K73 at (H/C)×VM of the kind of the coal used for obtaining the relationship;

B73 represents a part of the intercept of the straight line, which denotes a value equal to −A73{(H/C)×(VM−0)} when $K73=K73_0$;

A103 represents the inclination of the straight line represented by formula (40), covering the case where (H/C)×O is plotted on the abscissa and K103 is plotted in a logarithmic scale on the ordinate;

$K103_0$ represents a part of the intercept of the straight line crossing the ordinate, which denotes the value of K103 at (H/C)×O of the kind of the coal used for obtaining the relationship;

B103 represents a part of the intercept of the straight line, which denotes a value equal to −A103{(H/C)×O} when $K103=K103_0$;

A93 represents the inclination of the straight line represented by formula (41), covering the case where (N+S) is plotted on the abscissa and K93 is plotted in a logarithmic scale on the ordinate;

$K93_0$ represents a part of the intercept of the straight line crossing the ordinate, which denotes the value of K93 at (N+S) of the kind of the coal used for obtaining the relationship;

B93 represents a part of the intercept of the straight line, which denotes a value equal to −A93(N+S)×VM} when $K93=K93_0$;

A81 represents the inclination of the straight line represented by formula (42), covering the case where (H/C)×O is plotted on the abscissa and K81 is plotted in a logarithmic scale on the ordinate;

$K81_0$ represents a part of the intercept of the straight line crossing the ordinate, which denotes the value of K81 at (H/C)×O of the kind of the coal used for obtaining the relationship;

B81 represents a part of the intercept of the straight line, which denotes a value equal to −A81{(H/C)×O} when $K81=K81_0$;

A10 represents the inclination of the straight line represented by formula (43), covering the case where (H/C)×VM is plotted on the abscissa and K10 is plotted in a logarithmic scale on the ordinate;

$K10_0$ represents a part of the intercept of the straight line crossing the ordinate, which denotes the value of K10 at (H/C)×VM of the kind of the coal used for obtaining the relationship; and B10 represents a part of the intercept of the straight line, which denotes a value equal to −A10{(H/C)×VM} when $K10=K10_0$.

19. The method according to claim 18, wherein, when the liquefied oil or the solid liquefied product is classified into four components consisting of a liquefied oil component having a low boiling point, a liquefied oil component having an intermediate boiling point, a liquefied oil component having a high boiling point, and asphaltenes containing the liquefied oil, and when the other liquefied product is classified into four components consisting of a group of a lower hydrocarbon gas, a group consisting of carbon monoxide and carbon dioxide gases, a group consisting of water alone, and another group consisting of hydrogen sulfide and ammonia gases, the hydrocarbon compound group having 1 to 3 carbon atoms is classified as a lower hydrocarbon gas, a liquefied oil having a boiling point not higher than 220° C. under atmospheric pressure and excluding the lower hydrocarbon gas is classified as a liquefied oil component having a low boiling point, a liquefied oil having a boiling point not lower than 220° C. and lower than 350° C. under atmospheric pressure is classified as a liquefied oil component having an intermediate boiling point, a liquefied oil having a boiling point not lower than 350° C. and lower than 538° C. under atmospheric pressure is classified as a liquefied oil component having a high boiling point, and a liquefied oil having a boiling point not lower than 538° C. under atmospheric pressure and a solid component soluble in tetrahydrofuran are classified as asphaltenes.

20. The method according to claim 18, wherein, when the coal excluding the ash component is classified into three components consisting of a component having a high liquefying reactivity, a component having a low liquefying reactivity, and a component highly unlikely to be liquefied, the component of the coal having at least 0.5/min of a primary irreversible reaction rate constant of the conversion reaction from the coal into a liquefied product at 450° C. is classified as the component having a high liquefying reactivity, the component of the coal having the primary irreversible reaction constant smaller than 0.5/min and not smaller than $10^{-4}$/min is classified as the component having a low liquefying reactivity, and the component of the coal having the primary irreversible reaction constant smaller than $10^{-4}$/min is classified as the component highly unlikely to be liquefied.

* * * * *